US008807683B2

(12) United States Patent
Miura

(10) Patent No.: US 8,807,683 B2
(45) Date of Patent: Aug. 19, 2014

(54) LIQUID DISCHARGE METHOD FOR RESOLVING CLOGGED NOZZLE ARRAYS

(75) Inventor: Hirotsuna Miura, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 175 days.

(21) Appl. No.: 13/414,254

(22) Filed: Mar. 7, 2012

(65) Prior Publication Data

US 2012/0229547 A1 Sep. 13, 2012

(30) Foreign Application Priority Data

Mar. 10, 2011 (JP) ..... 2011-053262

(51) Int. Cl.
*B41J 29/38* (2006.01)
*B41J 2/165* (2006.01)

(52) U.S. Cl.
CPC ..... *B41J 2/16579* (2013.01); *B41J 2/16526* (2013.01)
USPC ..... 347/14

(58) Field of Classification Search
CPC ..... B41J 2/16526; B41J 2/16579
USPC ..... 347/14, 43
See application file for complete search history.

(56) References Cited

U.S. PATENT DOCUMENTS 5,587,730 A * 12/1996 Karz ..... 347/43

FOREIGN PATENT DOCUMENTS

JP 2003118149 * 4/2003
JP 2009-178868 8/2009

* cited by examiner

*Primary Examiner* — Laura Martin
*Assistant Examiner* — Carlos A Martinez
(74) *Attorney, Agent, or Firm* — Workman Nydegger

(57) ABSTRACT

A liquid discharge method including: performing a discharge operation of discharging liquid from each nozzle in a plurality of nozzle arrays, to each of which liquid is supplied from a corresponding container, the plurality of nozzle arrays corresponding to the plurality of containers which respectively contain a plurality of kinds of liquid, the nozzles being arranged in an array direction; detecting whether or not the liquid is discharged from each nozzle by the discharge operation; containing liquid to be discharged from a certain nozzle array in a container corresponding to a nozzle array which is different from the certain nozzle array when it is detected that there is a nozzle which does not discharge liquid in the certain nozzle array; and controlling the nozzle array which is different from the certain nozzle array to discharge the liquid to be discharged from the certain nozzle array.

8 Claims, 17 Drawing Sheets

| NOZZLE COLUMN | N1 | N2 | N3 | N4 | N5 | N6 | N7 | N8 | N9 |
|---|---|---|---|---|---|---|---|---|---|
| BEFORE CHANGE | Y | M | C | K | Op | W | Gr | Or | SPARE |
| AFTER CHANGE | Y | M | C | K | Op | X | Gr | Or | W |

| NOZZLE COLUMN | N1 | N2 | N3 | N4 | N5 | N6 | N7 | N8 | N9 |
|---|---|---|---|---|---|---|---|---|---|
| BEFORE CHANGE | Y | M | C | K | Op | Mk | Gr | Or | W |
| AFTER CHANGE | Y | M | C | K | Op | W | Gr | Or | X |

LIQUID DISCHARGE METHOD FOR RESOLVING CLOGGED NOZZLE ARRAYS

BACKGROUND

1. Technical Field

The present invention relates to a liquid discharge method.

2. Related Art

As a liquid discharge apparatus, an ink jet printer which discharges ink (a kind of liquid) onto a medium (a sheet of paper, for example) to print an image on the medium has been known. According to such a printer, there is a case in which it is not possible to discharge ink due to clogging of a nozzle which discharges ink. Such clogging of a nozzle results in missing of dots in the formed image, which may degrade image quality. Thus, a technique has been proposed according to which inspection regarding whether or not each nozzle can discharge ink is automatically performed and cleaning is performed when nozzle clogging is detected (see JP-A-2009-178868, for example).

For example, ink which contains a large amount of resin (resin ink) is used in an ink jet printer for business use or industrial use in order to enhance sheet adaptability and secure friction resistance and weather resistance. Since such ink does not dissolve again if the ink is once dried and solidified, it is difficult to cause a clogging nozzle to recover by cleaning or the like. Therefore, there is a problem in that it is necessary to replace a head regardless of the fact that the other nozzles can be used if a single nozzle clogs.

SUMMARY

An advantage of some aspects of the invention is to avoid head replacement due to nozzle clogging.

According to an aspect of the invention, there is provided a liquid discharge method including: performing a discharge operation of discharging liquid from each nozzle in a plurality of nozzle arrays, to each of which liquid is supplied from a corresponding container, the plurality of nozzle arrays corresponding to the plurality of containers which respectively contain a plurality of kinds of liquid, the nozzles being arranged in an array direction; detecting whether or not the liquid is discharged from each nozzle by the discharge operation; containing liquid to be discharged from a certain nozzle array in a container corresponding to a nozzle array which is different from the certain nozzle array when it is detected that there is a nozzle which does not discharge liquid in the certain nozzle array; and controlling the nozzle array which is different from the certain nozzle array to discharge the liquid to be discharged from the certain nozzle array.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
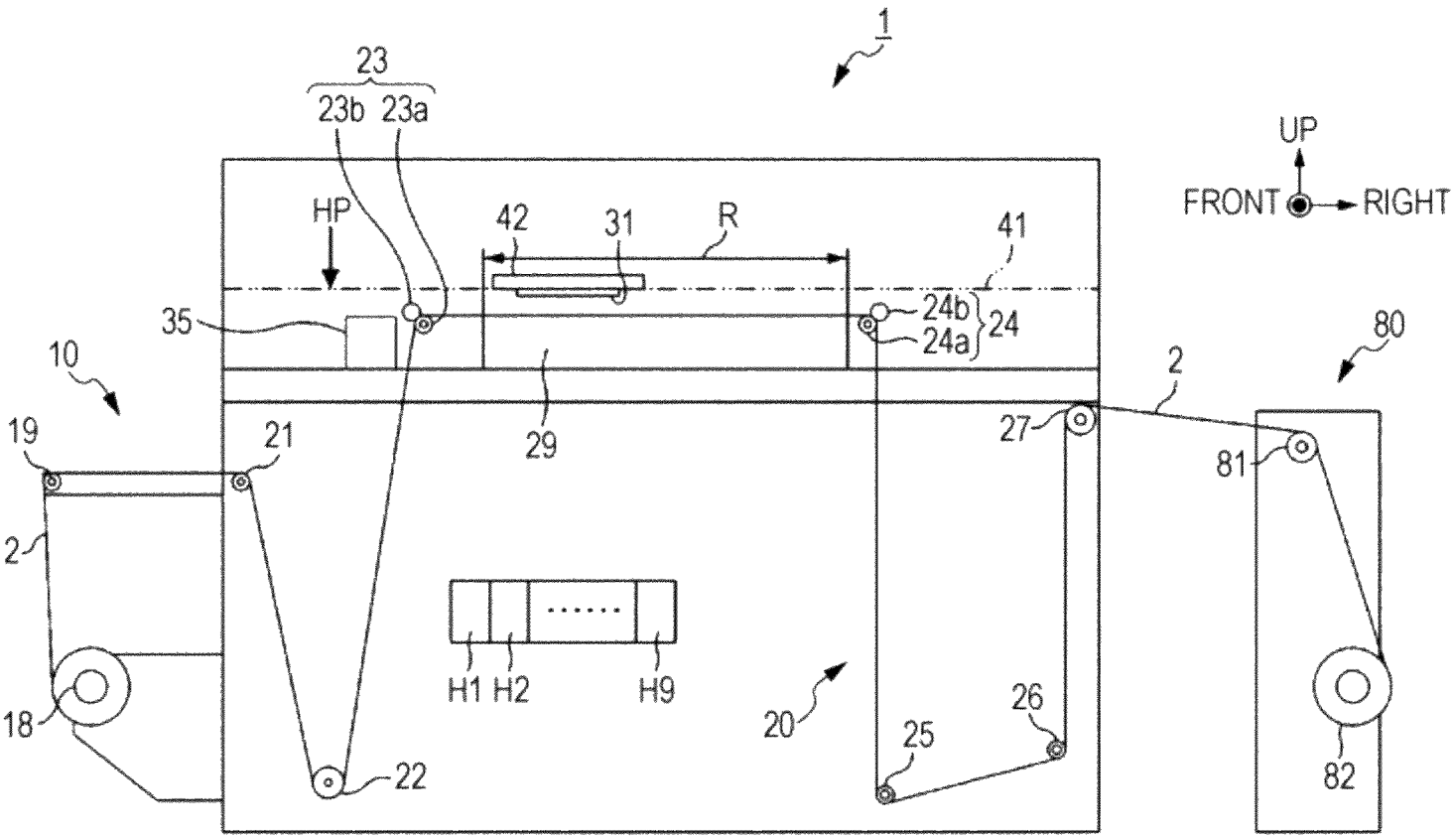
FIG. 1 is a cross-sectional view schematically showing a printer.

At least the following will be clarified in the description of the specification and accompanying drawings.

There is provided a liquid discharge method including: performing a discharge operation of discharging liquid from each nozzle in a plurality of nozzle arrays, to each of which liquid is supplied from a corresponding container, the plurality of nozzle arrays corresponding to the plurality of containers which respectively contain a plurality of kinds of liquid, the nozzles being arranged in an array direction; detecting whether or not the liquid is discharged from each nozzle by the discharge operation; containing liquid to be discharged from a certain nozzle array in a container corresponding to a nozzle array which is different from the certain nozzle array when it is detected that there is a nozzle which does not discharge liquid in the certain nozzle array; and controlling the nozzle array which is different from the certain nozzle array to discharge the liquid to be discharged from the certain nozzle array.

According to such a liquid discharge method, even when a nozzle in a certain nozzle array clogs, it is possible to discharge liquid with the use of another nozzle array. Accordingly, it is possible to avoid head replacement due to the nozzle clogging.

In such a liquid discharge method, the nozzle array which is different from the certain nozzle array may be a preliminary nozzle array.

According to a liquid discharge method, it is possible to easily change a nozzle array.

In such a liquid discharge method, a container corresponding to the certain nozzle array may contain first liquid, and a container corresponding to the nozzle array which is different from the certain nozzle array may contain second liquid. In addition, when it is detected that there is a nozzle which does not discharge liquid in the certain nozzle array, the liquid to be contained in the container corresponding to the nozzle array which is different from the certain nozzle array may be changed from the second liquid to the first liquid.

According to such a liquid discharge method, it is possible to effectively use a plurality of nozzle arrays.

In such a liquid discharge method, it is preferable that after detecting that there is a nozzle which does not discharge liquid in the certain nozzle array, nozzles other than the nozzle which does not discharge liquid be continuously used from among the nozzles in the certain nozzle arrays.

According to such a liquid discharge method, it is possible to suppress clogging of nozzles other than the nozzle which does not discharge liquid from among the nozzles in the certain nozzle array.

In such a liquid discharge method, it is preferable that the certain nozzle array and the nozzle array which is different from the certain nozzle array may alternately be used every time the discharge operation is performed on a predetermined region in a medium. In addition, the certain nozzle array may be used during flushing. In so doing, it is possible to suppress clogging.

In such a liquid discharge method, it is preferable that in a case in which liquid contained in a container corresponding to the nozzle array which is different from the certain nozzle array is changed from the second liquid to the first liquid, and color of the second liquid is created by combining liquid other than the second liquid in a predetermined head, in the predetermined head among a plurality of heads, each of which is provided with the plurality of nozzle arrays, arranged in an array direction, and provided with containers corresponding to the nozzle arrays, when a pass during which liquid is discharged from each nozzle array of each head while the plurality of heads are moved in a direction perpendicular to the array direction and a line change for displacing relative positions of the plurality of heads and the medium in the array direction between passes are alternately performed to form an image in a print region by a predetermined value, an addition value of the predetermined value due to the line change executed for the print region be set to be greater than length of each nozzle array in the array direction.

According to such a liquid discharge method, it is possible to allow a color difference in an image formed by each head to be imperceptible.

In such a liquid discharge method, it is preferable to further include: forming in the array direction a plurality of dot arrays in which dots are arranged in the perpendicular direction on the medium by discharging liquid to be discharged from the certain nozzle array by each nozzle in the nozzle array which is different from the certain nozzle array while the nozzle array which is different from the certain nozzle array is moved in the direction perpendicular to the array direction; detecting color strength of each dot array; calculating color strength correction value for each dot array based on the detected color strength; and applying the correction value when the liquid to be discharged from the certain nozzle array is discharged from each nozzle in the nozzle array which is different from the certain nozzle array.

According to such a liquid discharge method, it is possible to suppress occurrence of non-uniformity of the color strength due to the change in nozzle arrays to be used.

Hereinafter, description will be given of embodiments while a lateral ink jet printer (hereinafter, also referred to as a printer 1) is exemplified as a liquid discharge apparatus.

Configuration Example of Printer 1

Figure 2:
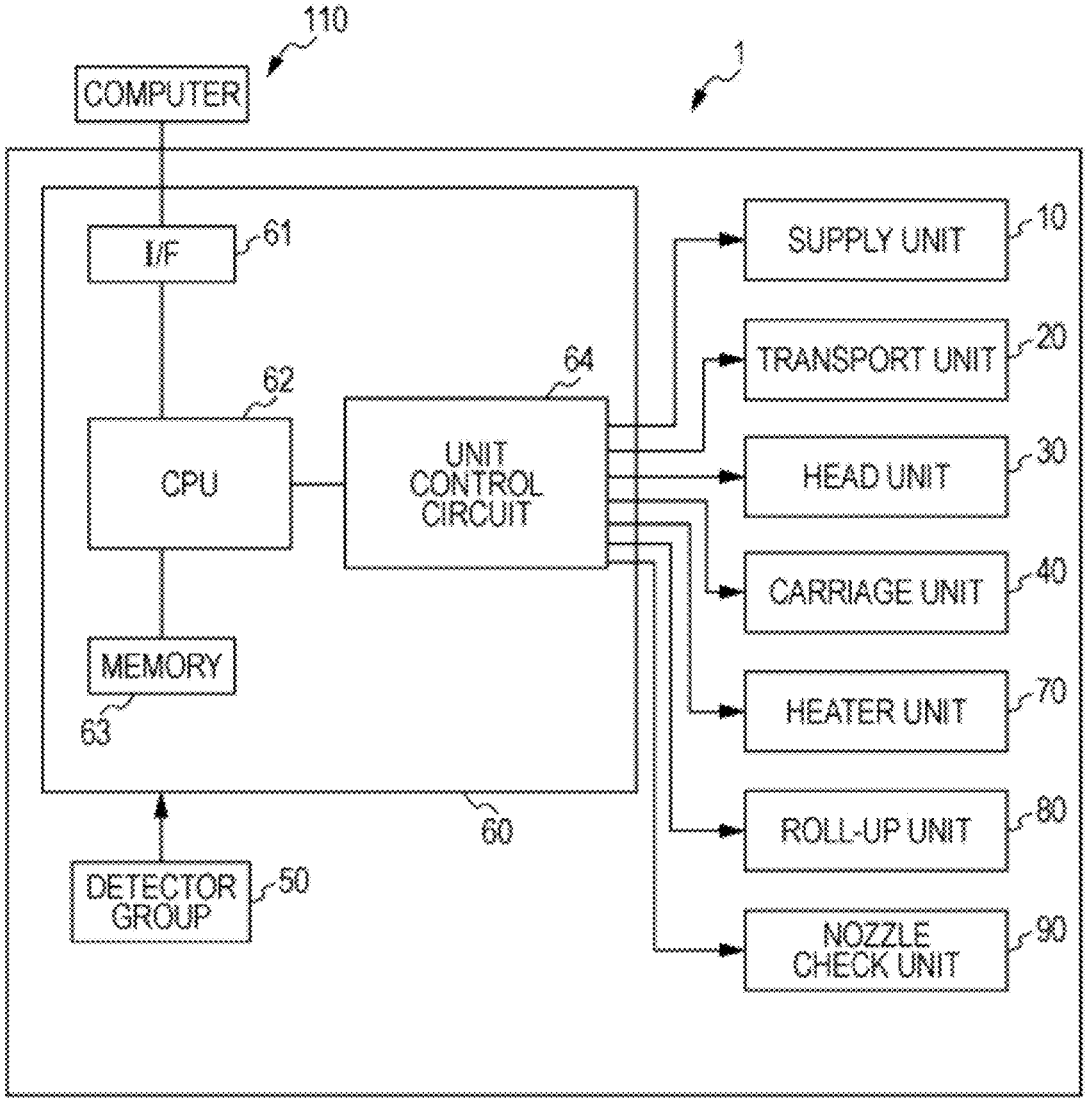
FIG. 2 is a block diagram of a printer.
Figure 3:
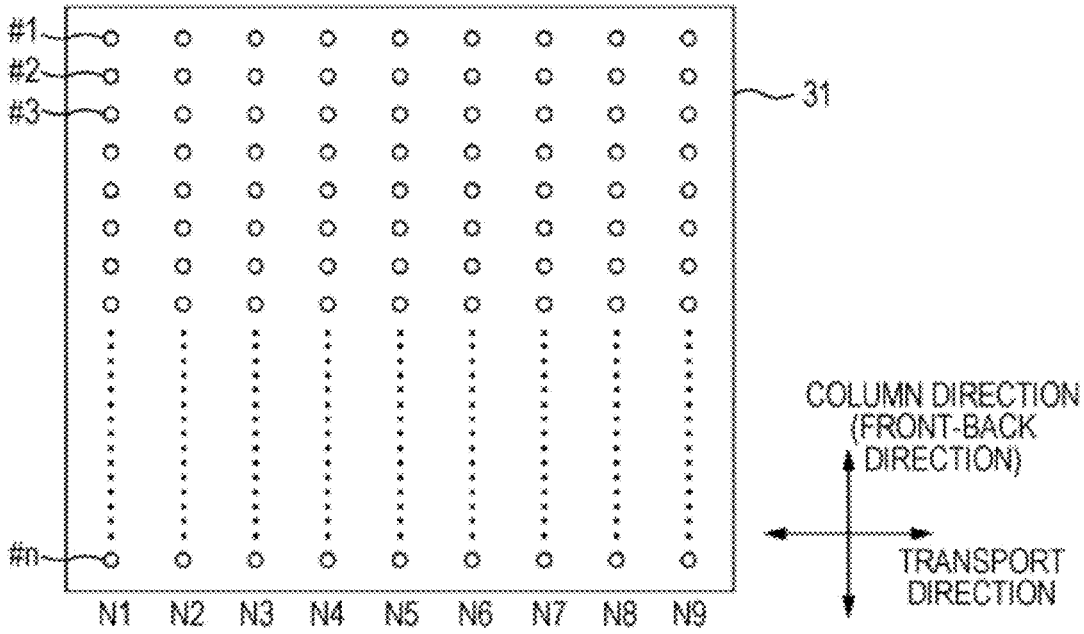
FIG. 3 is a diagram schematically showing a head configuration.

A configuration example of the printer 1 will be described with reference to FIGS. 1 to 3. FIG. 1 is a cross-sectional diagram schematically showing the printer 1. FIG. 2 is a block diagram of the printer 1. FIG. 3 is a diagram schematically showing a head configuration.

In the following description, terms "vertical direction" and "horizontal direction" means direction shown by arrows in FIG. 1 as references. In addition, a term "front-back direction" means a direction perpendicular to a sheet plane in FIG. 1.

In the embodiment, description will be given of a case in which a roll sheet 2 (sequential sheet) is used as a medium on which the printer 1 records an image.

The printer 1 according to the embodiment is provided with a transport unit 20, and a supply unit 10, a platen 29, and a roll-up unit 80 along a transport path through which the transport unit 20 transports the roll sheet 2 as shown in FIGS. 1 and 2, and further includes a head unit 30, a carriage unit 40, a cleaning unit, a flushing unit 35, a heater unit 70, a nozzle inspection unit 90, a controller 60 which controls the above units to manage operations as the printer 1, and a detector group 50.

The supply unit 10 supplies the roll sheet 2 to the transport unit 20. The supply unit 10 is provided with a winding shaft 18, around which the roll sheet 2 is wound, which is rotatably supported, and a relay roller 19 around which the roller sheet 2 reeled out from the winding shaft 18 is wound to guide the roll sheet 2 to the transport unit 20.

The transport unit 20 transports the roll sheet 2 supplied from the supply unit 10 along a preset transport path. As shown in FIG. 1, the transport unit 20 is provided with a relay roller 21 positioned on a horizontally right side of the relay roller 19, a relay roller 22 positioned obliquely downward on the right side when viewed from the relay roller 21, a first transport roller 23 positioned obliquely upward on the right side when viewed from the relay roller 22 (on the upstream side in a direction, in which the roller sheet 2 is transported, when viewed from the platen 29), a second transport roller 24 positioned on the right side when viewed from the first transport roller 23 (on the downstream side in the direction, in which the roller sheet 2 is transported, when viewed from the platen 29), and an inversion roller 25 positioned vertically downward when viewed from the second transport roller 24, a relay roller 26 positioned on the right side when viewed from the inversion roller 25, and a delivery roller 27 positioned upward when viewed from the relay roller 26.

The relay roller 21 is a roller which winds the roll sheet 2, which has been sent from the relay roller 19, from the left side and causes the roll sheet 2 to slack downward.

The relay roller 22 is a roller which winds the roll sheet 2, which has been sent from the relay roller 21, from the left side and transports the roll sheet 2 obliquely upward on the right side.

The first transport roller 23 is provided with a first driving roller 23*a* driven by a motor which is not shown in the drawing and a first driven roller 23*b* arranged so as to face the first driving roller 23*a* with the roll sheet 2 interposed therebetween. The first transport roller 23 is a roller for pulling up the roller sheet 2 which has been made to slack downward and transporting the roll sheet 2 to a print region R facing the platen 29. The first transport roller 23 temporally stops the transportation while an image is being recorded on a part of the roll sheet 2 on the print region R (that is, an image for one page is recorded on the part by moving the head 31 in the horizontal direction and the front-back direction to discharge ink onto the part of the stopping roll sheet 2). In addition, when the first driven roller 23*b* is rotated with the rotation of the first driving roller 23*a* by the drive control of the controller 60, a transport amount of the roll sheet 2 (a length of a part of the roll sheet) to be positioned on the platen 29 is adjusted.

As described above, the transport unit 20 has a mechanism for causing a part of the roll sheet 2, which is wound between the relay rollers 21 and 22 and the first transport roller 23 to slack downward and transport the roll sheet 2. The slack of the roll sheet 2 is monitored by the controller 60 based on a detection signal from a slack detecting sensor which is not shown in the drawing. Specifically, since appropriate tension is applied to the part of the roll sheet 2, which is made to slack between the relay rollers 21 and 22 and the first transport roller 23, when the slack detecting sensor detects the part, the transport unit 20 can transport the roll sheet 2 in a slacking state. On the other hand, since excess tension is applied to the part of the slacking roll sheet 2 when the slack detecting sensor does not detect the part, the transport of the roll sheet 2 by the transport unit 20 is temporally stopped, and the tension is appropriately adjusted.

The second transport roller 24 is provided with a second driving roller 24*a* driven by a motor which is not shown in the drawing and a second driven roller 24*b* arranged so as to face the second driving roller 24*a* with the roll sheet 2 interposed therebetween. The second transport roller 24 is a roller which transports vertically downward the part of the roll sheet 2 after an image is recorded by the head unit 30 after transporting the part in the horizontally right direction along a supporting plane of the platen 29. Thus, the transport direction of the roll sheet 2 is shifted. In addition, by rotating the second driven roller 24*b* with the rotation of the second driving roller 24*a* by the drive control of the controller 60, predetermined tension to be applied to the part of the roll sheet 2 positioned on the platen 29 is adjusted.

The inversion roller 25 is a roller which winds the roll sheet 2, which has been sent from the second transport roller 24, from the upper direction on the left side and transports the roll sheet 2 obliquely upward on the right side.

The relay roller 26 is a roller which winds the roll sheet 2, which has been sent from the inversion roller 25, from the lower direction on the left side and transports the roll sheet 2 upward.

The delivery roller 27 winds the roll sheet 2, which has been sent from the relay roller 26, from a lower direction on the left side and sends the roll sheet 2 to the roll-up unit 90.

Since the roll sheet 2 sequentially passes through each roller and moves as described above, a transport path for transporting the roll sheet 2 is formed. In addition, the roll sheet 2 is intermittently transported along the transport path in units of regions corresponding to the print region R by the transport unit 20 (that is, intermittent transport is performed every time an image for one page is recorded on a part of the roll sheet 2 on the print region R).

The head unit 30 discharges ink as an example of liquid onto a part of the roll sheet 2 sent into the print region R on the transport path (on the platen 29) by the transport unit 20. The head unit 30 includes a head 31. As shown in FIG. 1, cartridge holders H1 to H9 (corresponding to containers) to which ink cartridges are detachably attached are provided in the printer 1. In addition, the ink cartridges, each of which contains various kinds (colors) of ink, are detachably attached to the cartridge holders H1 to H9. In other words, each color of ink is contained in each of the cartridge holders H1 to H9. Here, each of the cartridge holders H1 to H9 correspond to each of nozzle arrays (nozzle arrays N1 to N9) of the head 31, which will be described later. Moreover, the ink in each ink cartridge attached to each of the cartridge holders H1 to H9 is supplied to the head 31 via an ink supply tube which is not shown in the drawing. The head 31 discharges ink supplied from each cartridge holder. In this embodiment, ink with colors of yellow (Y), magenta (M), cyan (C), black (K), Clear (Op), matte black (Mk), green (Gr), orange (Or), white (W), and the like is used. In the following description, such ink is also referred to as Y ink, M ink, C ink, K ink, Op ink, Mk ink, Gr ink, and Or ink, respectively. It is matter of course that kinds (number of colors) of ink can be appropriately set, and that a configuration in which monochrome print is performed only with black ink, a configuration in which two colors of ink is used, or a configuration in which a number of colors is arbitrarily set so as not to be nine colors but to be three colors or more can also be applied. In addition, a configuration can also be applied in which a moisturizer cartridge containing moisturizer is attached to the cartridge holder.

Each of the ink cartridges is electrically connected to the controller 60 via the cartridge holders H1 to H9 to which the ink cartridges are attached. In addition, the controller 60 can read information such as a kind (color) of ink, a remaining amount, and the like from a recording element (not shown) mounted on each ink cartridge and write information in the recording element.

As shown in FIG. 3, the head 31 includes a plurality of nozzle arrays (nozzle arrays N1 to N9 in this embodiment), in each of which nozzles are arranged in an array direction, on the lower surface thereof. Each of the nozzle arrays includes n nozzles from #1 to #n. The nine nozzle arrays N1 to N9 respectively correspond to the cartridge holders H1 to H9. For example, when the nozzle array N1 is for yellow (Y), an ink cartridge for Y ink is attached to the cartridge holder H1. Then, the Y ink in the ink cartridge is supplied to the nozzle array N1 via the ink supply tube (not shown). Each of the nozzles #1 to #n in each nozzle array are linearly arranged in a perpendicular direction which is perpendicular to a transport direction of the roll sheet 2 (that is, the perpendicular direction corresponds to the aforementioned array direction). Each of the nozzle arrays is arranged in a parallel manner with intervals therebetween along the transport direction.

A piezoelectric element (not shown) is provided as a drive element for discharging an ink droplet in each of the nozzles #1 to #n. If a voltage with a predetermined time width is applied between electrodes provided on both ends, the piezoelectric element is expanded in accordance with voltage application time and deforms the side walls of the ink flow path. In so doing, content of the ink flow path contracts in accordance with the expansion of the piezoelectric element, and the ink corresponding to the amount of contraction is discharged as ink droplets from each of the nozzles #1 to #n for each color.

In addition, the head 31 can reciprocate in the transport direction (namely, the horizontal direction) and the array direction (namely, the front-back direction) as will be described later.

The carriage unit 40 moves the head 31. The carriage unit 40 includes a carriage guide rail 41 extending in the transport direction (horizontal direction) (shown by a two-dotted chain line in FIG. 1), a carriage 42 supported so as to be capable of reciprocating in the transport direction (horizontal direction) along the carriage guide rail 41, and a motor which is not shown in the drawing.

The carriage 42 is driven by the motor, which is not shown in the drawing, to move in the transport direction (horizontal direction) integrally with the head 31. In addition, the carriage 42 is provided with a head guide rail extending in the array direction (front-back direction) which is not shown in the drawing, and the head 31 is driven by the motor to move in the array direction (front-back direction) along the head guide rail.

The cleaning unit (not shown) is for cleaning the head 31. The cleaning unit is provided at a home position (hereinafter, referred to as HP; see FIG. 1) and includes a cap, a suction pump, and the like. When the head 31 (carriage 42) moves in the transport direction (horizontal direction) and is positioned at HP, the cap which is not shown in the drawing is adhered to the lower surface (nozzle surface) of the head 31. When the suction pump is operated in a state in which the cap is adhered as described above, the ink within the head 31 is suctioned with ink whose viscosity has been improved and paper powder. In so doing, the cleaning of the head is completed by allowing the clogging nozzle to recover from the non-discharging state.

In addition, the flushing unit 35 is provided between the HP and the platen 29 in the transport direction (horizontal direction), and the head 31 executes a flushing operation for flushing by discharging ink from each nozzle belonging to the nozzle array when the head 31 (carriage 42) moves in the transport direction (horizontal direction) and is positioned at a position facing the flushing unit 35.

The platen 29 supports a part of the roll sheet 2 positioned in the print region R on the transport path and heats the part. As shown in FIG. 1, the platen 29 is provided so as to correspond to the print region R on the transport path and arranged in a region between the first transport roller 23 and the second transport roller 24 along the transport path. Moreover, the platen 29 can heat the part of the roll sheet 2 by receiving heat supply generated by the heater 70.

The heater unit 70 heats the roll sheet 2 and includes a heater which is not shown in the drawing. The heater includes a nichrome wire and is configured such that the nichrome wire is arranged inside the platen 29 so as to be separated from the supporting surface of the platen 29 by a predetermined distance. Therefore, the nichrome wire itself generates heat by power distribution, and the heater can deliver the heat to the part of the roll sheet 2 positioned on the supporting surface of the platen 29. Since the heater is configured such that the nichrome wire is installed in the entire platen 29, it is possible to uniformly deliver heat to the part of the roll sheet 2 on the platen 29. According to this embodiment, the part of the roll sheet 2 is uniformly heated such that the temperature of the part of the roll sheet 2 on the platen becomes 45° C. In so doing, it is possible to dry the ink which has been reached to the part of the roll sheet 2.

The roll-up unit 80 rolls up the roll sheet 2 which has been sent by the transport unit 20 (the roll sheet on which an image has been recorded). The roll-up unit 80 includes a relay roller 81 which winds the roll sheet 2 sent from the delivery roller 27 from the upper direction on the left side and transport the roll sheet obliquely downward on the right side and a roll-up driving shaft 82 which is rotatably supported and rolls up the roll sheet 2 sent from the relay roller 81.

The nozzle inspection unit 90 automatically detects whether or not ink is discharged from each nozzle in nozzle arrays of the head 31.

In addition, detailed description will be given of the nozzle inspection unit 90.

The controller 60 is a control unit which controls the printer 1. As shown in FIG. 2, the controller 60 is provided with an interface unit 61, a CPU 62, a memory 63, and a unit control circuit 64. The interface unit 61 exchanges data between a host computer 110 as an external device and the printer 1. In addition, as the data received by the printer 1 from the host computer 110, print data, command data, and the like can be exemplified.

The CPU 62 is a computation processing device for controlling the entire printer 1. The memory 63 secures a region for storing programs of the CPU 62, an operation region, and the like. The CPU 62 controls each unit by a unit control circuit 64 based on programs stored in the memory 63.

The detector group 50 monitors a condition in the printer 1, and examples thereof include a rotary type encoder which is attached to a transport roller, for example, to be used for controlling medium transport and the like, a sheet detecting sensor which detects whether or not there is a medium to be transported, a linear encoder which detects a position of the carriage 42 (or the head 31) in the transport direction (horizontal direction), and the like.

Operation Example of Printer 1

As described above, the printer 1 according to the embodiment is provided with the head 31 including nozzle arrays, in each of which nozzles are arranged in the array direction (front-back direction). When the controller 60 moves the head 31 in the transport direction (horizontal direction) and causes the nozzles to discharge ink to form raster lines in the transport direction (horizontal direction), an image for one page is recorded on a part of the roll sheet 2 on the print region R.

Here, the controller 60 according to the embodiment executes printing of a plurality of passes (6 passes, 8 passes, 16 passes, or the like). That is, in order to enhance resolution of an image in the array direction, printing is performed while the position of the head 31 in the array direction is slightly changed for each pass. In addition, known interlace (MicroWave) printing is executed, for example, as an image forming method.

Figure 4:
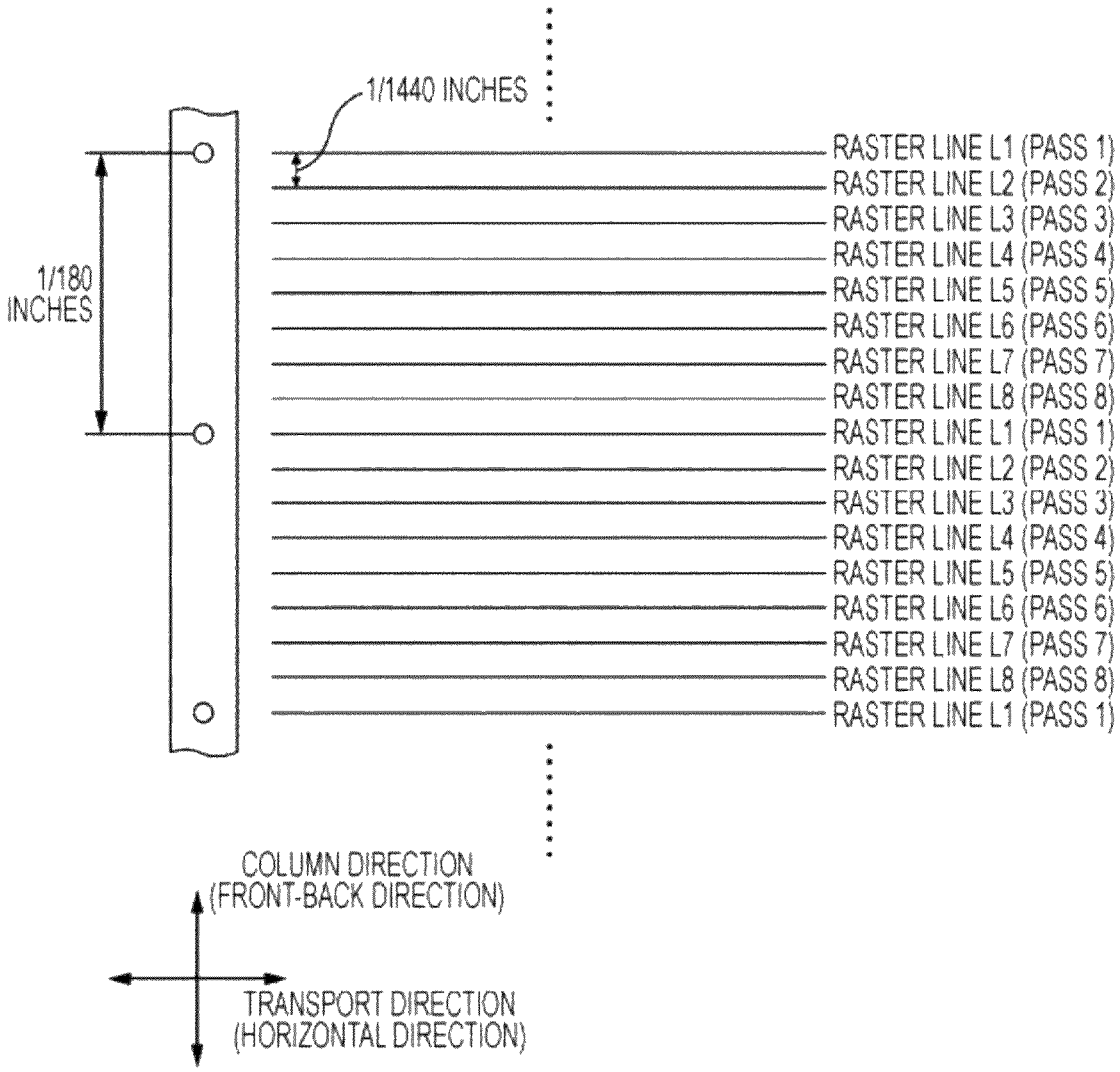
FIG. 4 is a diagram schematically showing a raster line formed by each pass when printing is performed with 8 passes.

This will be described more specifically with reference to FIG. 4. FIG. 4 is a diagram schematically showing a raster line formed by each pass in a case of printing with 8 passes.

A nozzle array (nozzles) of the head 31 is shown on the left side in FIG. 4, and raster lines are formed when the head 31 (nozzle array) moves in the transport direction and ink is discharged from the nozzles. The position of the head 31 (nozzle array), which is shown in the drawing, in the array direction, is a position in the case of the first pass, the printing by the first pass is executed when the head 31 (nozzle array) moves in the transport direction while maintaining such a position, and three raster lines (raster line L1 with a description of pass 1 on the right end) shown in the drawing are formed.

Subsequently, when the head 31 (nozzle array) moves in the array direction and then moves in the transport direction while maintaining the position after the movement in the array direction, printing by the second pass is executed, and two raster lines (raster line L2 with a description of pass 2 on the right end) shown in the drawing are formed. Since the interlace (MicroWave) printing is employed, the raster line L2 adjacent to the raster line L1 is formed with ink discharged from different nozzles from those which has discharged ink to form the raster line L1. For this reason, a movement distance of the head 31 (nozzle array) in the array direction is not 1/8 of a distance between nozzles (1/180 inches, for example) ($1/180 \times 1/8 = 1/1440$ inches) but a distance greater than this (hereinafter, this distance is referred to as a distance d).

Thereafter, the same operations are performed to execute printing by the third to eighth passes, and the rest of the raster lines (raster lines L3 to L8 with descriptions of pass 3 to pass 8 on the right ends) shown in the drawing are formed. By forming raster lines with 8 passes as described above, it is possible to achieve image resolution, which is eight times higher (=1440÷180), in the array direction.

In the embodiment, so-called bidirectional printing is performed. That is, a movement direction of the head 31 (nozzle array) when printing by the first pass, the third pass, the fifth pass, and the seventh pass is performed is opposite to a movement direction of the head 31 (nozzle array) when printing by the second pass, the fourth pass, the sixth pass, and the eighth pass is performed (as will be described later in detail).

Hereinafter, description will be given of an image recording operation (in other words, an ink discharge operation) of the printer 1 as an operation example of the printer 1. The description will be given of the aforementioned case in FIG. 4 in which printing is performed with 8 passes, as an example (FIG. 4 will be appropriately referred to in the following description). For simplification, the description will be given on the assumption that the number of nozzle arrays is just one (not multiple). In the embodiment, a flushing operation is performed between the image recording operations as will be described later.

Image Recording Operation Example and Flushing Operation Example of Printer 1

Figure 5:
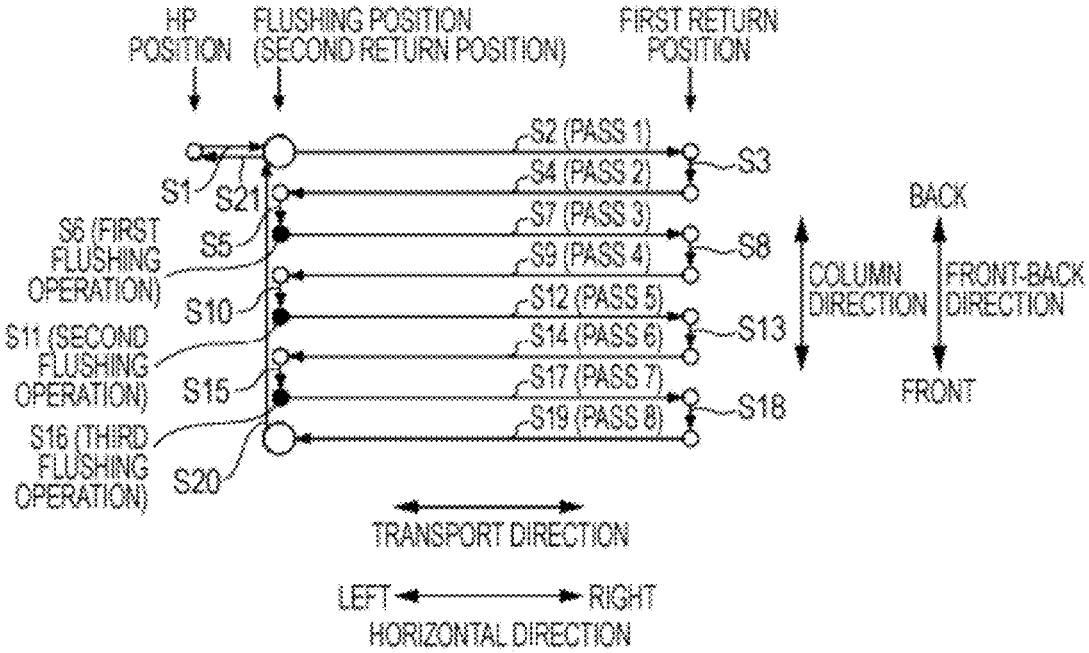
FIG. 5 is an explanatory diagram schematically illustrating head movement.

Here, description will be given of an example of an image recording operation and an example of a flushing operation executed between the image recording operations of the printer 1 with reference to FIGS. 4 and 5. FIG. 5 is an explanatory diagram schematically illustrating movement of the head 31. Before explaining the image recording operation and the flushing operation, description will firstly be given of (how to see) FIG. 5.

FIG. 5 shows how the head 31 moves during the print processing (namely, a series of processing relating to image recording and flushing). The head 31 is shown by a circle (although there are large circles and small circles in the drawing, a difference in sizes does not have any meaning), and the movement of the head 31 is shown by arrows, for convenience. Here, arrows directing in the horizontal direction in the drawing show the movement of the head 31 in the transport direction, and arrows directing in the vertical direction shows the movement of the head 31 in the array direction. In addition, reference numerals from S1 to S21 are added to arrows, which are step numbers to be used in the following description regarding print processing.

In addition, there are step numbers to which pass 1 to pass 8 are added, such step numbers show steps in which the image recording operation is executed by discharging ink.

In addition, there are white circles and black circles among circles positioned at flushing positions, the black circles mean that the flushing operation is executed (on the other hand, the white circles mean that the flushing operation is not executed). Reference numerals of S6, S11, and S16 are added to the black circles, the reference numerals are step numbers to be used in the following description regarding print processing.

Hereinafter, description will be given of print processing with reference to FIGS. 4 and 5. The print processing is realized mainly by the controller 60. Particularly, in the embodiment, the print processing is realized by the CPU 62 performing processing of a program stored in the memory 63. In addition, the program is configured by codes for various operations which will be described later.

When the aforementioned intermittent transport of the roll sheet 2 is performed, and the roll sheet 2 is then stopped, the print processing for recording an image for one page on a part of the roll sheet 2 on the print region R is started.

First, the controller 60 moves the head 31 in an outgoing direction (a direction from an upstream side to a downstream side in a direction in which the roll sheet 2 is transported) from the HP position (Step S1).

When the head 31 passes the aforementioned flushing position in the course of time (the flushing operation is not executed at this time), the controller 60 causes the head 31 to discharge ink while continuing the movement of the head 31 in the outgoing direction to execute printing by the first pass (Step S2). In so doing, the raster line L1 shown in FIG. 4 (the raster line by the pass 1) is formed.

When the head 31 reaches a first return position, the controller 60 moves the head 31 in the array direction (Step S3). In the embodiment, the head 31 is moved by the distance d.

Thereafter, the controller 60 causes the head 31 to discharge ink while moving the head 31 in the return direction (a direction from the downstream side to the upstream side in the direction in which the roll sheet 2 is transported) to execute printing for the second pass (Step S4). In so doing, the raster line L2 (the raster line by the pass 2) shown in FIG. 4 is formed.

When the head 31 reaches the flushing position (this position is also a second return position), the controller 60 moves the head 31 in the array direction (Step S5). In the embodiment, the head 31 is moved by the distance d.

Then, when the movement is completed, the controller 60 causes the head 31 to execute the flushing operation (referred to as a first flushing operation) in which ink is discharged from each nozzle belonging to the nozzle array to perform flushing (Step S6).

Then, the controller 60 performs twice more the same processing as that from Step S2 to Step S6 (Step S7 to Step S11, Step S12 to Step S16). In the first processing, a raster line L3 (a raster line by the pass 3) shown in FIG. 4 and a raster line L4 (a raster line by the pass 4) shown in FIG. 4 are formed by the printing of the third pass (Step S7) and the printing by the fourth pass (Step S9), respectively. In addition, the flushing operation (the second operation, Step S11) is also executed.

A rater line L5 (a raster line by the pass 5) shown in FIG. 4 and a raster line L6 (a raster line by the pass 6) shown in FIG. 4 are formed by the printing of the fifth pass (Step S12) and the printing of the sixth path (Step S14), respectively, in the second processing. In addition, the flushing operation (the third flushing operation, Step S16) is also executed.

Next, the controller 60 executes the printing of the last two passes. That is, the controller 60 causes the head 31 to discharge ink while moving the head 31 in the outgoing direction to execute the printing by the seventh pass (Step S17). In so doing, a raster line L7 (a raster line by the pass 7) shown in FIG. 4 is formed. When the head 31 reaches the first return position, the controller 60 moves the head 31 in the array direction (Step S18). In the embodiment, the head 31 is moved by the distance d. Thereafter, the controller 60 causes the head 31 to discharge ink while moving the head 31 in the return direction to execute printing by the eighth pass (Step S19). In so doing, a raster line L8 (a raster line by the pass 8) shown in FIG. 4 is formed.

When the head 31 reaches the flushing position (the flushing operation is not executed at this time), the controller 60 returns the position of the head 31 in the array direction to an original position (Step S20). That is, the head 31 is moved by the distance 7*d* in a direction which is opposite to the direction in which the head 31 has moved in Steps S3, S5, S8, S10, S13, S15, and S18.

Then, the controller 60 completes the print processing for recording an image for one page by moving the head 31 from the flushing position to the HP position (Step S21).

Outline of Processing by Printer Driver

Figure 6:
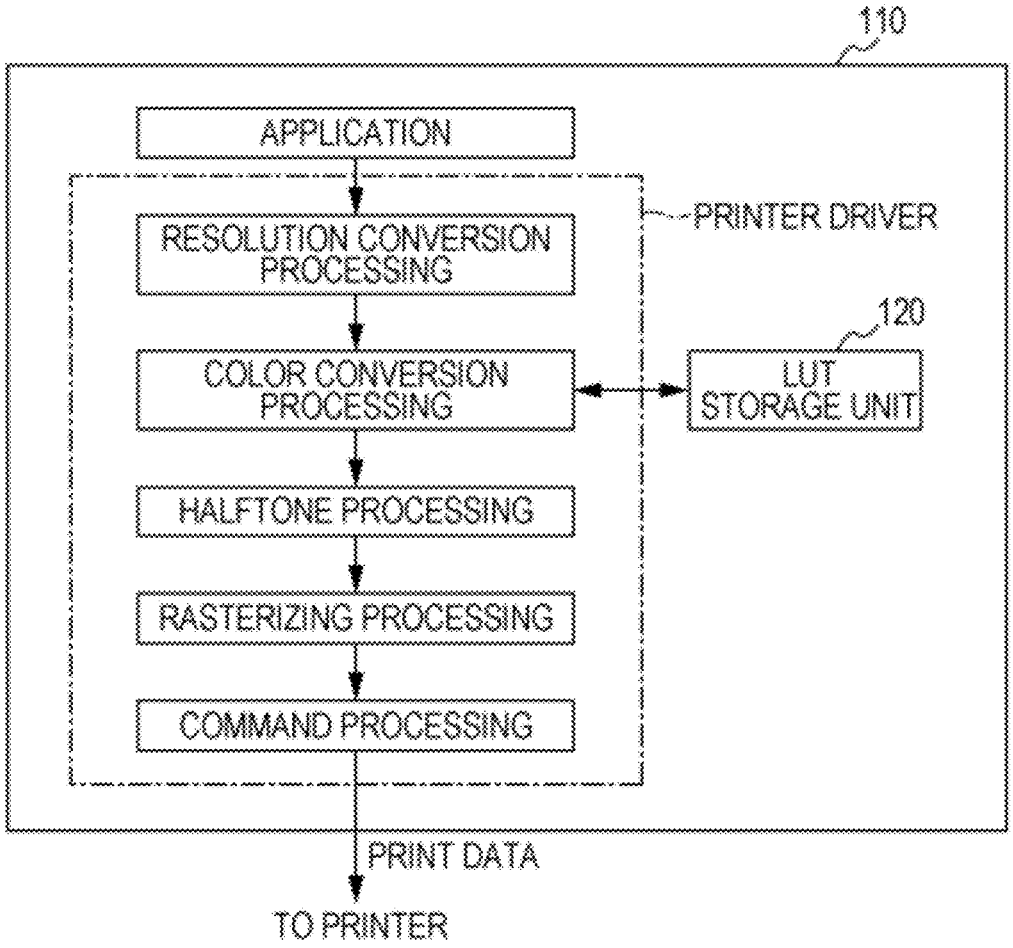
FIG. 6 is an explanatory diagram of processing by a printer driver.

The above print processing is started by transmitting print data from the host computer 110 connected to the printer 1 as described above. The print data is created by processing of the printer driver. Hereinafter, description will be given of the processing of the printer driver with reference to FIG. 6. FIG. 6 is an explanatory diagram of processing by the printer driver.

The printer driver receives image data from an application program, converts the image data into print data in a form which can be interpreted by the printer 1, and outputs the print data to the printer. When the image data from the application program is converted into the print data, the printer driver performs resolution conversion processing, color conversion processing, halftone processing, rasterizing processing, command addition processing, and the like.

The resolution conversion processing is processing in which the image data (text data, image data, or the like) output from the application program is converted to have resolution for printing on a sheet (print resolution). For example, when the print resolution is designated as 720×720 dpi, the image data based on the vector form received from the application program is converted into image data based on the bitmap form with the resolution of 720×720 dpi. In addition, each pixel data item in the image data after the resolution conversion processing is RGB data of multiple gradations (256 gradations, for example) represented by an RGB color space. The gradation value is determined based on the RGB image data.

The color conversion processing is processing in which the RGB data is converted into data of a CMYK color space. In addition, the CMYK color space is a color space corresponding to ink (colors) used in the printer 1. In other words, the printer driver creates image data of a CMYK plane based on the RGB data. For example, when four colors of ink including CMYK are used, image data of a CMYK plane is created.

The color conversion processing is performed based on a table in which the gradation value of the RGB data is associated with the gradation value of the CMYK data in accordance with the ink to be used. This table is referred to as a color conversion lookup table (LUT). In addition, the pixel data after the color conversion processing is data of 256 gradations represented by the CMYK color space.

The halftone processing is processing in which high gradation data is converted into gradation data which can be formed by a printer. By the halftone processing, the data representing 256 gradations is converted into one-bit data representing two gradations or two-bit data representing four gradations. In the image data after the halftone processing, one bit or two bits of pixel data corresponds to each pixel, and the pixel data is data representing a dot formation state (presence of a dot, size of a dot) of each pixel. For example, in the case of two bits (four gradations), conversion is performed in four stages including a stage in which there is no dot is formed corresponding to a dot gradation value "00", a stage in which a small dot corresponding to a dot gradation value "01" is formed, a stage in which an intermediate dot corresponding to a dot gradation value "10" is formed, and a stage in which a large dot corresponding to a dot gradation value "11" is formed. Thereafter, a dot creation ratio is determined for each size of the dot, and the pixel data is then created such that the printer 1 forms the dots so as to be dispersed, with the use of a dither method, a γ correction, an error diffusion method, and the like.

In the rasterizing processing, the pixel data arranged in a matrix shape is rearranged for each pixel data item in an order of data to be transferred to the printer 1. For example, the pixel data is rearranged in accordance with an arrangement order of the nozzles of each head.

The command addition processing is processing in which data representing a command in accordance with a print scheme is added to rasterized data. As a command, it is possible to exemplify a transport command, an adsorption command, a carriage movement command, and the like, for example.

The print data created by such processing is transmitted to the printer 1 by the printer driver.

As shown in FIG. 5, the host computer 110 includes a LUT storage unit 120. The LUT storage unit 120 stores the color conversion LUT used in the color conversion processing from the RGB color space to the CMYK color space. As described above, the color conversion LUT is a table which defines a correspondence relationship between data in a certain color space and a data in another color space for a plurality of lattice points. In the embodiment, a plurality of color conversion LUTs are created in advance in accordance with the combinations of the ink types (colors) to be used, and the color conversion LUTs are stored in the LUT storage unit 120.

Concerning Nozzle Inspection Unit

Configuration of Nozzle Inspection Unit

Figure 7:
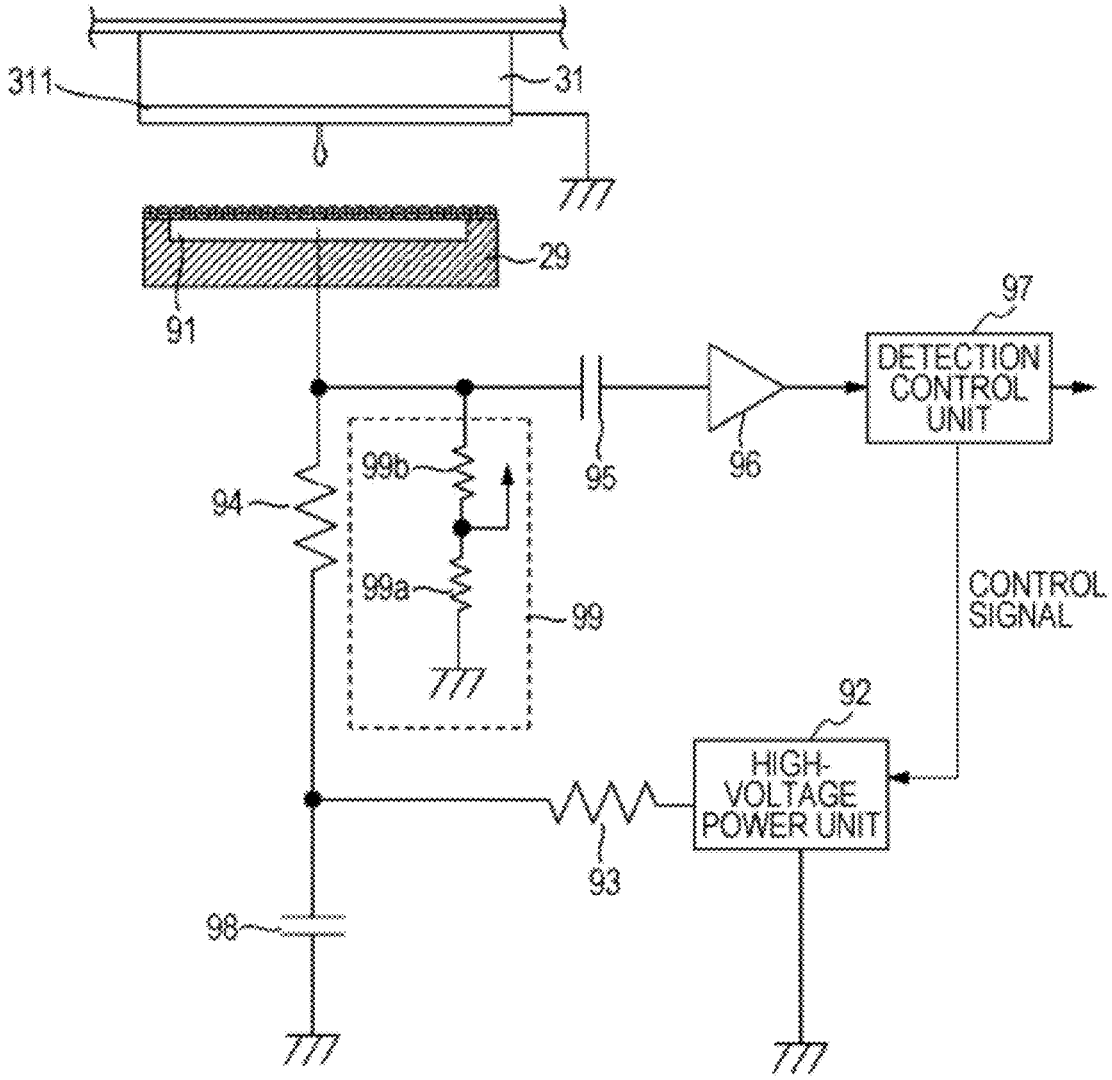
FIG. 7 is an explanatory diagram of a nozzle inspection unit.

FIG. 7 is an explanatory diagram showing an example of a nozzle inspection unit 90. The nozzle inspection unit 90 is provided with a detecting electrode 91, a high-voltage power unit 92, a first limiting resistor 93, a second limiting resistor 94, a detecting capacitor 95, an amplifier 96, a detection control unit 97, a smoothing capacitor 98, and a voltage detecting unit 99. In addition, a nozzle plate 311 of the head 31 is connected to a ground having a ground potential and functions as a part of the nozzle inspection unit 90.

The detecting electrode 91 is formed with a metal wire to have a spider web shape. If the detecting electrode 91 has high potential, potential becomes high not only in a region of the metal wire with the spider web shape but also in a wide range.

The high-voltage power unit 92 is a power source which adjusts the potential of the detecting electrode 91 to predetermined potential. The high-voltage power unit according to the embodiment is configured by a DC power of about 600 V to 1000 V.

The first limiting resistor 93 and the second limiting resistor 94 are arrange between the high-voltage power unit 92 and the detecting electrode 91 to control current flowing between the high-voltage power unit 92 and the detecting electrode 91. Both the first limiting resistor 93 and the second limiting resistor 94 according to the embodiment have resistance values of 1.6 MSΩ.

The detecting capacitor 95 is an element for extracting a potential variation component of the detecting electrode 91. One end of the detecting capacitor 95 is connected to the detecting electrode 91, and the other end is connected to the amplifier 96. A bias component (DC component) of the detecting electrode 91 is removed by the detecting capacitor 95. The detecting capacitor 95 according to the embodiment has a capacity of 4700 pF.

The amplifier 96 amplifies a signal on the side of the other end of the detecting capacitor 95. The amplifier 96 according to the embodiment has an amplification ratio of 4000 times. In so doing, it is possible to obtain a detection signal, potential of which is changed at about 3V, from the amplifier 96.

The detection control unit 97 controls the nozzle inspection unit 90 and determines whether or not there is nozzle clogging based on the detection signal output from the amplifier 96.

The smoothing capacitor 98 suppresses sudden change in potential. One end of the smoothing capacitor 98 is connected to the first limiting resistor 94 and the second limiting resistor 95, and the other end is connected to the ground. The smoothing capacitor 98 according to the embodiment has content of 0.1 μF.

The voltage detecting unit 99 detects whether or not the detecting electrode 91 has predetermined voltage. The voltage detecting unit 99 includes a first resistor 99*a* and a second resistor 99*b* which configure a voltage-dividing circuit. The first resistor 99*a* and the second resistor 99*b* are connected to each other in series, one end of the first resistor 99*a* has the same potential as that of the detecting electrode 91, and the second resistor 99*b* is connected to the ground. By detecting the potential between the first resistor 99*a* and the second resistor 99*b* by the controller 60, it is possible to determine whether or not the detecting electrode 91 has predetermined voltage. The first resistor 99*a* according to the embodiment has a resistance value of 6 MΩ, and the second resistor 99*b* has a resistance value of 33 kΩ.

Operations of Nozzle Inspection Unit

When ink is discharged from the nozzles formed in the nozzle plate 311, the potential of the detecting electrode 91 is changed, and the potential change is detected by the detecting capacitor 95 and the amplifier 96, and the detecting signal is output to the detection control unit 97. Since no ink is discharged when there is nozzle clogging, the potential of the detecting electrode 91 is not changed, and no change in voltage appears in the detection signal.

By detecting a difference in the voltage change, it is possible to determine whether or not ink has been discharged from the nozzles.

In addition, although the nozzle inspection is performed by detecting the voltage change of the detecting electrode 91 according to the embodiment, a method for the nozzle inspection is not limited thereto, and another method can also be performed. In the following description, a nozzle which does not discharge ink due to clogging or the like will also be referred to as a non-discharging nozzle.

Concerning Processing During Nozzle Inspection

Figure 8:
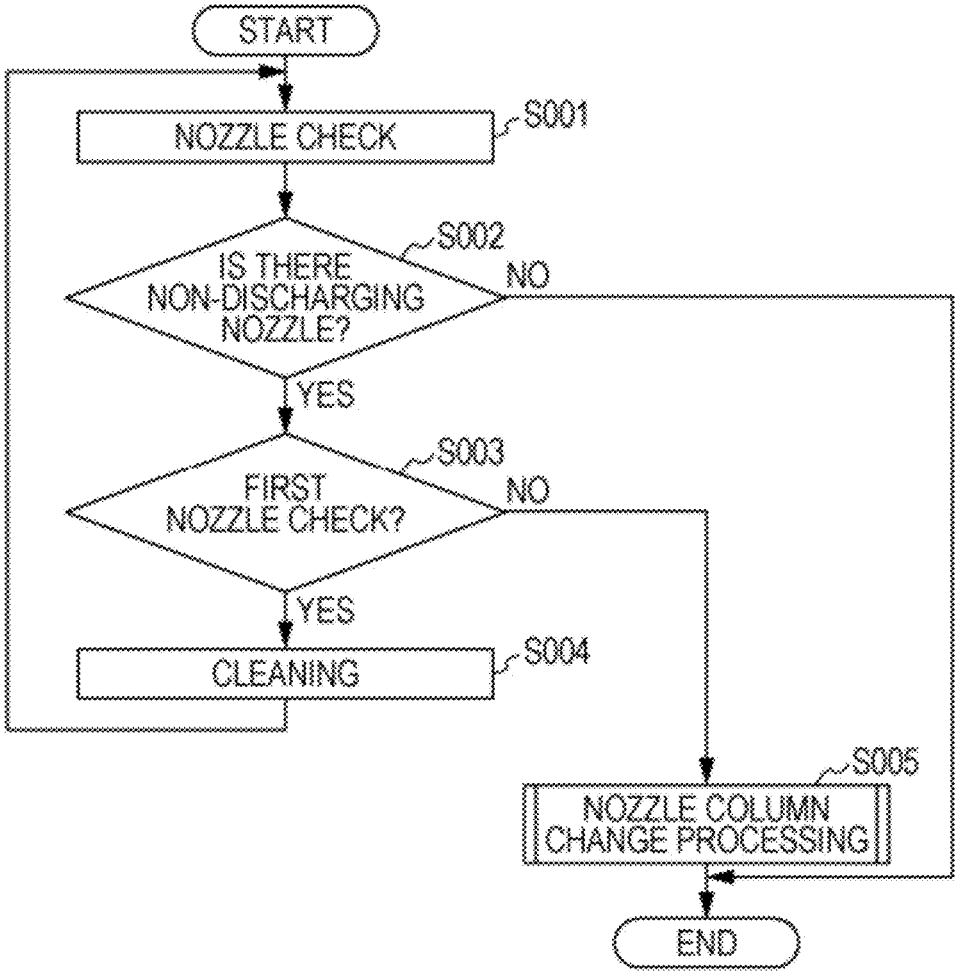
FIG. 8 is a diagram showing a flow of processing during nozzle inspection according to an embodiment.

FIG. 8 is a diagram showing a flow of processing during the nozzle inspection according to the embodiment.

First, the controller 60 causes the nozzle inspection unit 90 to execute nozzle inspection (hereinafter, also referred to as nozzle check) for nozzles of each nozzle array in the head 31 at predetermined timing (S001). This timing may appropriately be set to be timing of turning on the power of the printer 1, timing of starting the printing, timing in a predetermined cycle, or the like.

Then, the controller 60 determines whether or not there is a non-discharging nozzle in each nozzle array of the head 31 based on an inspection result of the nozzle check by the nozzle inspection unit 90 (S002). If there is no non-discharging nozzle as a result of the nozzle check (No in S002), the processing of nozzle inspection is completed.

When there is a non-discharging nozzle as a result of the nozzle check (Yes in S002), the cleaning unit which is not shown in the drawing is made to perform cleaning of the head 31 (S004) if the executed nozzle check is the first check (Yes in S003). Then, the processing returns to Step S001, and the nozzle check is performed again.

When it is determined in Step S003 that the nozzle check is not the first check (No in S003), the controller 60 determines that it is difficult to recover the state by cleaning and executes nozzle array change processing (S005).

Figures 9, 10:
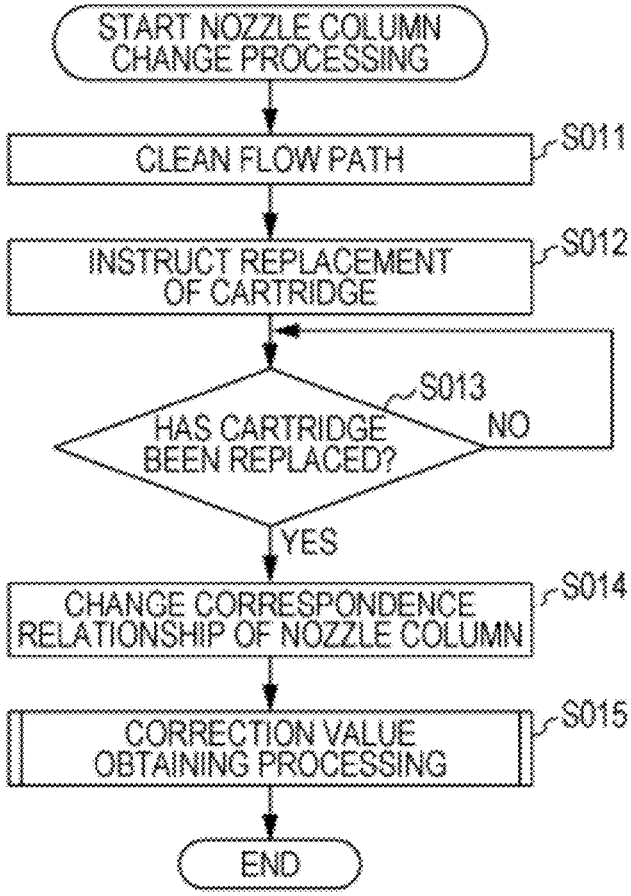
FIG. 9 is a diagram showing a flow of nozzle array change processing.
FIG. 10 is a diagram showing correspondence relationships between a nozzle array and ink (color) before and after nozzle array change processing.

FIG. 9 is a diagram showing a flow of the nozzle array change processing. FIG. 10 is a diagram showing correspondence relationships between the nozzle array and the ink (colors) before and after the nozzle array change processing.

As shown in FIG. 10, yellow (Y), magenta (M), cyan (C), black (K), clear (Op), white (W), green (Gr), and orange (Or) are set as ink (colors) corresponding to the nozzle arrays N1 to N8 before the nozzle array change processing. That is, ink cartridges of corresponding ink are attached to the cartridge holders H1 to H8 corresponding thereto. For example, an ink cartridge for Y ink is attached to the cartridge holder H1. In addition, the nozzle array M9 is a preliminary nozzle array, and no ink cartridge is attached to the cartridge holder H9. In addition, a moisturizer cartridge for containing moisturizer may be attached to the cartridge holder H9, for example.

Hereinafter, description will be given of processing when nozzle clogging is detected in the nozzle array N6 (W) in the nozzle inspection. First, an ink flow path corresponding to the preliminary nozzle array (the nozzle array N9 in the embodiment) is washed (S011). Here, washing of the ink flow path may be omitted when the nozzle array N9 has not been used at all. Then, the controller 60 instructs a user to replace the ink cartridge (S012). For example, the controller 60 causes a display of the host computer 110 to display a screen for instructing the replacement of the cartridge. More specifically, the controller 60 causes the display of the host computer 110 to display a screen for instructing the shift of the cartridge holder H6 corresponding to the nozzle array N6 with the cartridge holder H9 corresponding to the preliminary nozzle array N9. The controller 60 determines whether or not the ink cartridge has been replaced by reading information of a storage element in the ink cartridge attached to the cartridge holder H9 (S013). When the controller 60 determines that the ink cartridge has been replaced (Yes in S013), the controller 60 changes a correspondence relationship between each nozzle array and discharged ink (S014). According to the embodiment, the correspondence relationship (a discharge position, timing, and the like) between the ink and the nozzle array is changed is changed such that W ink to be discharged by the nozzle array N6 is discharged by the nozzle array N9.

If the nozzle array is changed as described above, there is a concern in that non-uniformity occurs in the color strength due to differences in the nozzle discharge properties of the nozzle arrays. Thus, the controller 60 executes correction value obtaining processing after changing the correspondence relationship between nozzle arrays (S015). Hereinafter, description will be given of an outline of the correction value obtaining processing.

Concerning Correction Value Obtaining Processing

Figure 11:
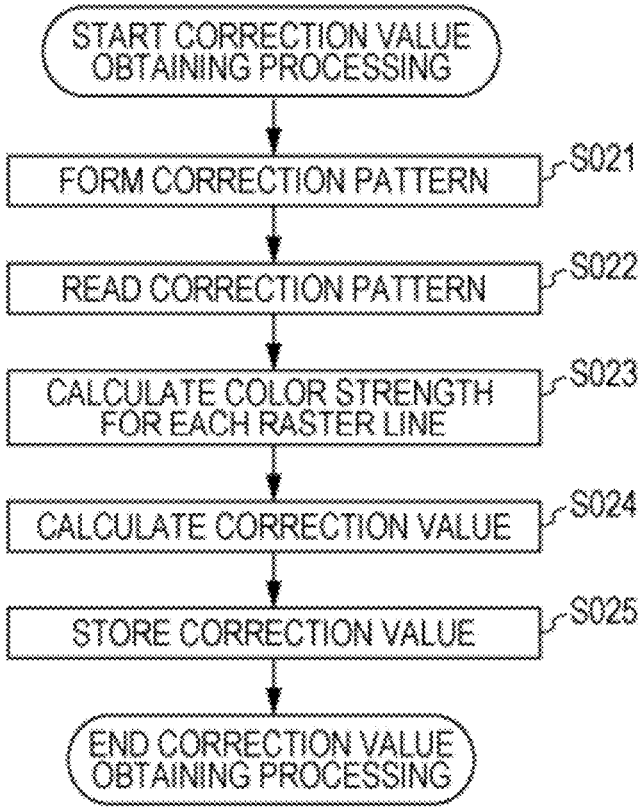
FIG. 11 is a diagram showing a flow of correction value obtaining processing.

FIG. 11 is a diagram showing a flow of the correction value obtaining processing. When the processing is performed for the printer 1 which is capable of performing multi-color printing as in the embodiment, the correction value obtaining processing of each ink color is performed in the same procedure. Hereinafter, description will be given of the correction value obtaining processing for one ink color (yellow, for example).

Figure 12:
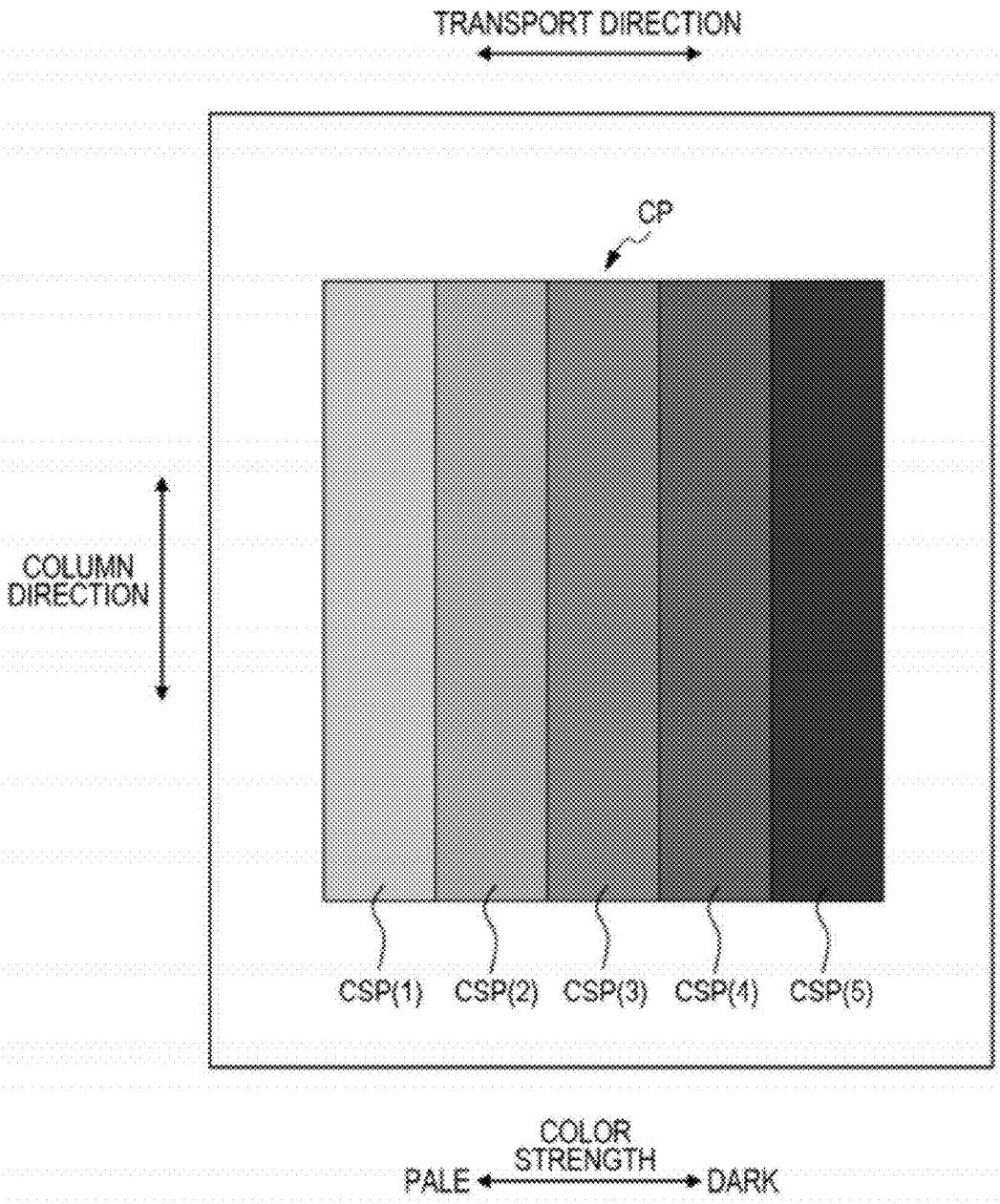
FIG. 12 is an explanatory diagram of correction pattern CP.

First, the host computer 110 transmits print data of correction pattern to the printer 1, and the printer 1 forms the correction pattern CP on a medium (S021). The correction pattern CP is formed by a sub pattern CSP with five kinds of color strength as shown in FIG. 12. FIG. 12 is an explanatory diagram of the correction pattern CP.

Each sub pattern CSP is a band-shaped pattern and is configured such that a plurality of raster lines in the transport direction is arranged in the array direction. In addition, each sub pattern CSP is generated from image data with a predetermined gradation value (ordered gradation value), and the color strength becomes higher in order from the left sub pattern CSP as shown in FIG. 8. The ordered gradation values for sub patterns CSP are represented as Sa, Sb, Sc, Sd, and Se (Sa<Sb<Sc<Sd<Se) in order from the left. In addition, the sub pattern CSP formed with the ordered gradation value Sa is represented as CSP (1) as shown in FIG. 8. Similarly, the sub patterns CSP formed with the ordered gradation values Sb, Sc, Sd, and Se are represented as CSP (2), CSP (3), CSP (4), and CSP (5), respectively.

Next, the host computer 110 causes a scanner (not shown) to read the correction pattern CP and obtains a result (S022). The scanner includes three sensors corresponding to R (red), G (green), and B (blue), irradiates the correction pattern CP with light, and detects reflection light with each sensor.

Then, the host computer 110 calculates color strength of the raster line of each sub pattern CSP based on the read gradation value obtained by the scanner (S023). Hereinafter, the color strength calculated based on the read gradation value will also be referred to as calculated color strength.

Figure 13:
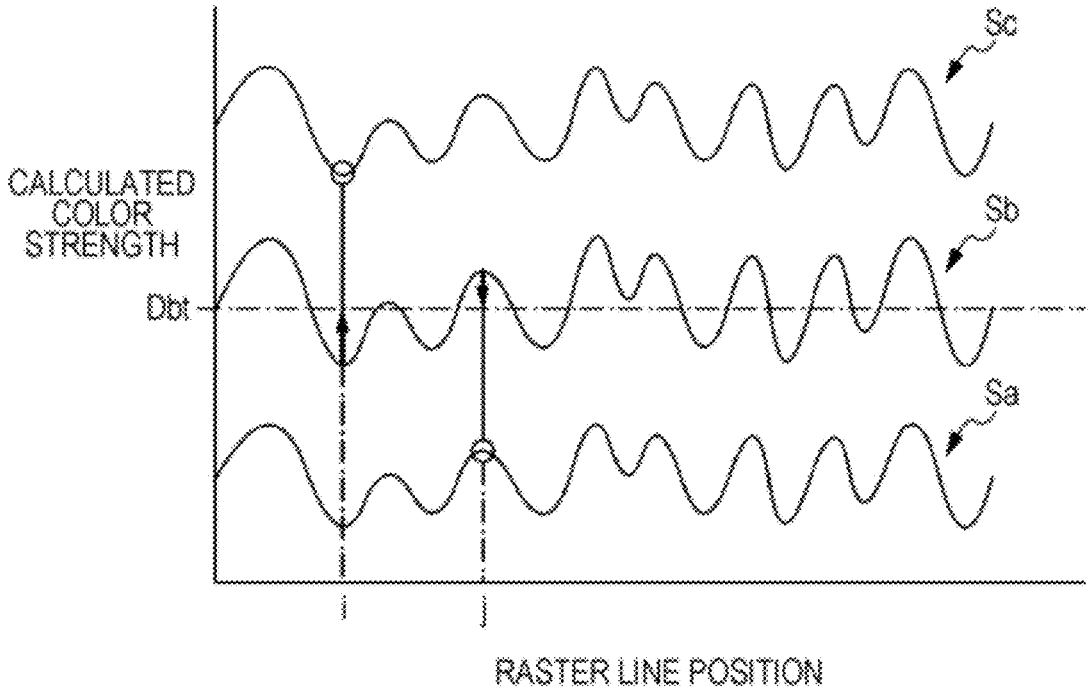
FIG. 13 is a graph showing a calculated color strength of each raster line for a sub pattern CSP in which ordered gradation values are Sa, Sb, and Sc.

FIG. 13 is a graph showing calculated color strength of each raster line for the sub patterns CSP in which the ordered gradation values are Sa, Sb, and Sc. The horizontal axis in FIG. 13 shows positions of raster lines, and the vertical axis shows the degree of the calculated color strength. As shown in FIG. 13, differences in color strength occurs in the raster lines regardless of that each sub pattern CSP is formed with the same ordered gradation value. The differences in the color strength result in the non-uniformity of the color strength in the printed image.

Next, the host computer 110 calculates a color strength correction value H for each raster line (S024). The color strength correction value H is calculated for each ordered gradation. Hereinafter, the color strength correction values H calculated for the ordered gradations Sa, Sb, Sc, Sd, and Se are referred to as Ha, Hb, Hc, Hd, and He, respectively. In order to explain a calculation procedure of the color strength correction value H, description will be given of an example in which the color strength collection value Hb is calculated for correcting the ordered gradation value Sb such that the calculated color strength of the raster line for the sub pattern CSP (2) with the ordered gradation value Sb becomes constant. In the procedure, an average value Dbt of the calculated color strength of all raster lines for the sub pattern CSP (2) with the ordered gradation value Sb is set as target color strength for the ordered gradation value Sb. In FIG. 13, the ordered gradation value Sb may be corrected such that the color becomes darker for the i-th raster line in which the calculated color strength is lower than the target color strength Dbt. On the other hand, the ordered gradation value Sb may be corrected such that the color becomes lighter for the j-th raster line in which the calculated color strength is higher than the target color strength Dbt.

Figure 14A:
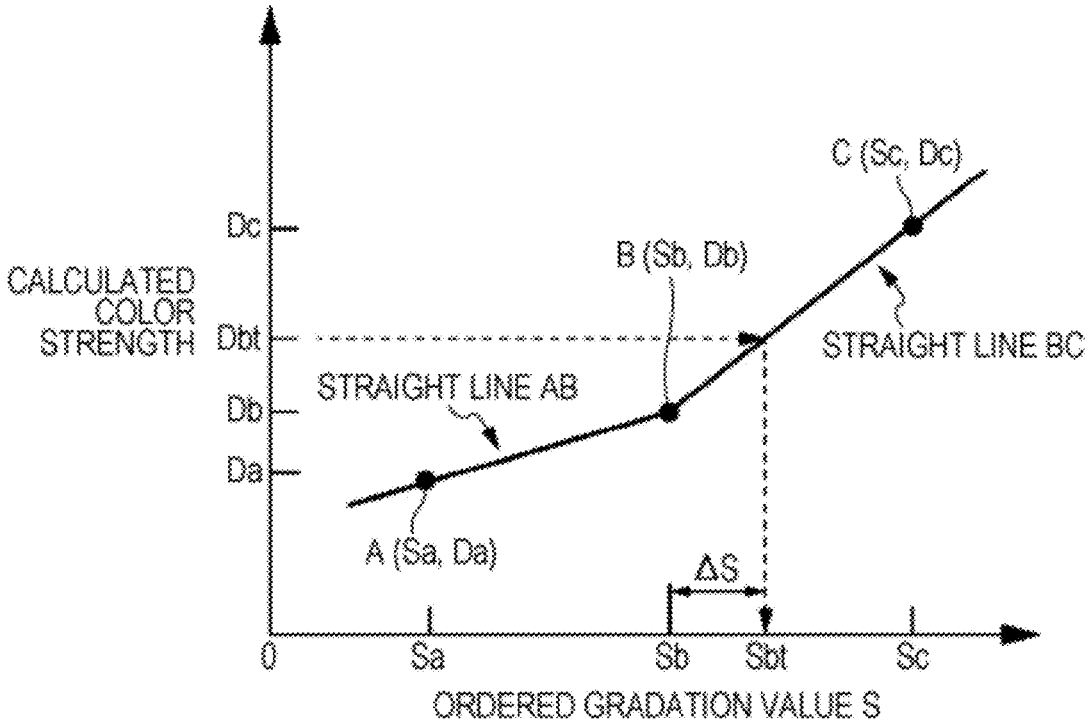
FIG. 14A is an explanatory diagram showing a procedure for calculating a color strength correction value Hb for correcting an ordered gradation value Sb for an i-th raster line.
Figure 14B:
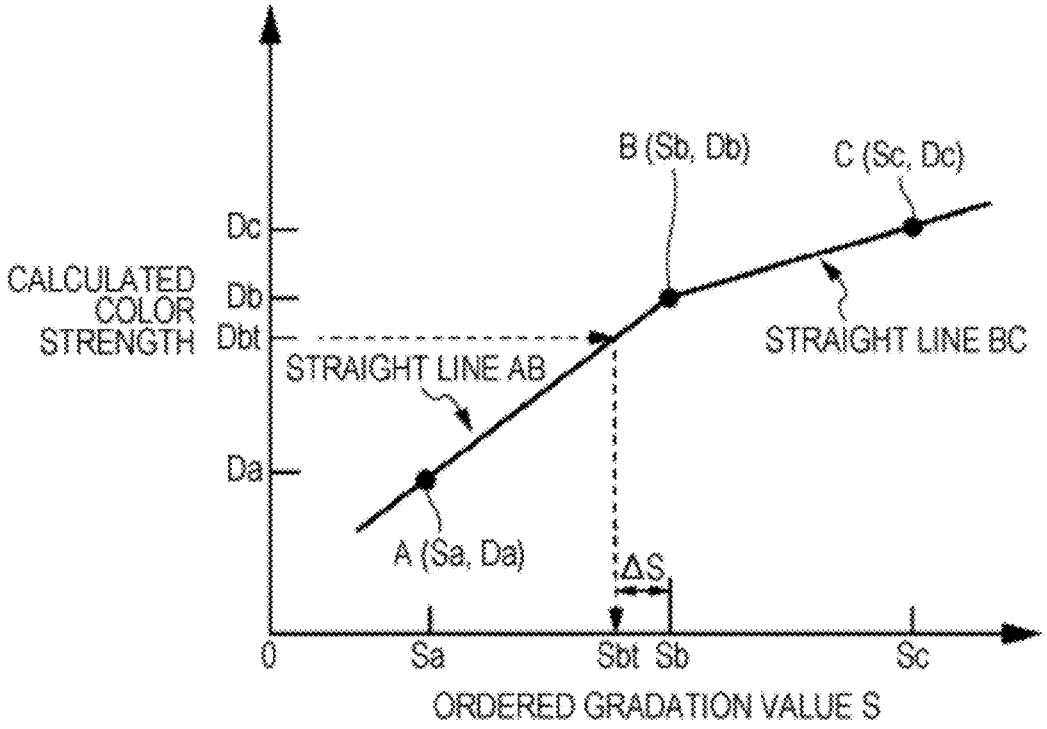
FIG. 14B is an explanatory diagram showing a procedure for calculating a color strength correction value Hb for correcting an ordered gradation value Sb for a j-th raster line.

FIG. 14A is an explanatory diagram of a procedure for calculating the color strength correction value Hb for correcting the ordered gradation value Sb for the i-th raster line. FIG. 14B is an explanatory diagram of a procedure for calculating the color strength correction value Hb for correcting the ordered gradation value Sb for the j-th raster line. The horizontal axis represents the size of the ordered gradation value, and the vertical axis represents the calculated color strength, in FIGS. 14A and 14B.

The color strength correction value Hb for the ordered gradation value Sb of the i-th raster line is calculated based on the calculated color strength Db of the i-th raster line in the sub pattern CSP (2) with the ordered gradation value Sb shown in FIG. 14A and the calculated color strength Dc of the i-th raster line in the sub pattern CSP (3) with the ordered gradation value Sc. More specifically, the calculated color strength Db of the i-th raster line is lower than the target color strength Dbt in the sub pattern CSP (2) with the ordered gradation value Sb. In other words, the color strength of the i-th raster line is lower than the average color strength. If it is desired to form the i-th raster line such that the calculated color strength Db of the i-th raster line becomes equal to the target color strength Dbt, the gradation value of the pixel data corresponding to the i-th raster line, namely the ordered gradation value Sb may be corrected to the target ordered gradation value Sbt calculated by the following equation (1) with the use of straight-line approximation from the correspondence relationships (Sb, Db) and (Sc, Dc) between the ordered gradation value of the i-th raster line and the calculated color strength as shown in FIG. 14A.

$$Sbt=Sb+(Sc-Sb)\times\{(Dbt-Db)/(Dc-Db)\} \quad (1)$$

Then, the color strength correction value H for correcting the ordered gradation value Sb for the i-th raster line is obtained by the following equation (2) based on the ordered gradation value Sb and the target ordered gradation value Sbt.

$$Hb=\Delta S/Sb=(Sbt-Sb)/Sb \quad (2)$$

On the other hand, the color strength correction value Hb for the ordered gradation value Sb of the j-th raster line is calculated based on the calculated color strength Db of the j-th raster line in the sub pattern CSP (2) with the ordered gradation value Sb shown in FIG. 14B and the calculated color strength Da of the j-th raster line in the sub pattern CSP (1) with the ordered gradation value Sa. Specifically, the calculated color strength Db of the j-th raster line is higher than the target color strength Dbt in the sub pattern CSP (2) with the ordered gradation value Sb. If it is desired to form the j-th raster line such that the calculated color strength Db of the j-th raster line becomes equal to the target color strength Dbt, the ordered gradation value Sb of the j-th raster line may be corrected to the target ordered gradation value Sbt calculated by the following formula (3) with the use of straight-line approximation from the correspondence relationships (Sa, Da) and (Sb, Db) between the ordered gradation value of the j-th raster line and the calculated color strength as shown in FIG. 10B.

$$Sbt=Sb+(Sb-Sa)\times\{(Dbt-Db)/(Db-Da)\} \quad (3)$$

Then, the color strength correction value Hb for correcting the ordered gradation value Sb for the j-th raster line is obtained by the above equation (2).

As described above, the host computer 110 calculates the color strength correction value Hb for the ordered gradation value Sb for each raster line. Similarly, the color strength correction values Ha, Hc, Hd, and He for the ordered gradation values Sa, Sc, Sd, and Se are calculated for each raster line. In addition, the color strength correction values Ha to He for each of the ordered gradation values Sa to Se are calculated for each raster line in relations to the other ink colors.

Thereafter, the host computer 110 transmits the data of the color strength correction value H to the printer 1 and causes the memory 63 in the printer 1 to store the data (S025). As a result, a correction table in which color strength correction values Ha to He for each of the five ordered gradation values Sa to Se are arranged for each raster line (hereinafter, also referred to as a BRS correction table) is created in the memory 63 in the printer 1.

Figure 15:
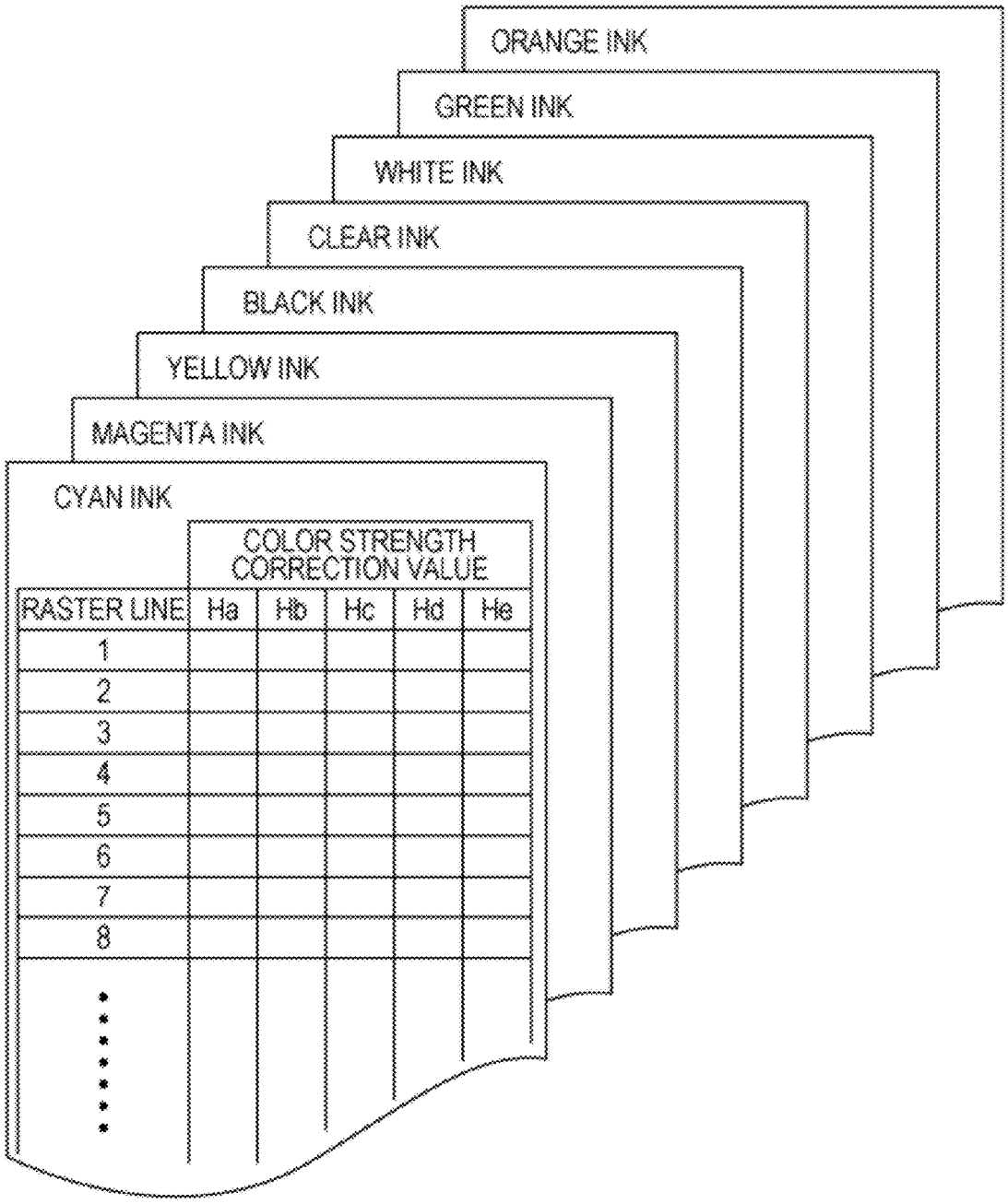
FIG. 15 is a diagram showing a BRS correction table.

FIG. 15 is a diagram showing a BRS correction table stored in the memory 63. By performing the aforementioned correction value obtaining processing for each ink color, the BRS correction table is created for each ink color as shown in FIG. 15. As a result, the BRS correction tables are formed, the number of which corresponds to the number of ink colors. The BRS correction tables are referred to by the printer driver in order to correct the gradation value for each raster line constituting image data of an image when the image is printed by the printer 1.

When the printing is performed, the image with the color strength corrected by the color strength correction value H is printed.

For example, the printer driver of the host computer 110 corrects a gradation value of each pixel data (hereinafter, the gradation value before correction is referred to as Sin) based on the color strength correction value H for the raster line corresponding to the pixel data (hereinafter, the gradation value after correction is referred to as Sout).

Specifically, when the gradation value Sin of a certain raster line is the same as one of the ordered gradation values Sa, Sb, Sc, Sd, and Se, it is possible to use the color strength correction value H, which is stored in the memory of the host computer 110, as it is. For example, when the gradation value Sin of the pixel data is equal to Sb, the gradation value Sout after correction can be obtained by the following equation.

$$Sout=Sb\times(1+Hb) \quad (4)$$

On the other hand, when the gradation value of the pixel data is different from any of the ordered gradation value Sa, Sb, Sc, Sd, and Se, a correction value is calculated based on interpolation using the color strength correction value for the peripheral ordered gradation values. For example, when the ordered gradation value Sin is between the ordered gradation value Sb and the ordered gradation value Sc, the gradation value Sout after correction of the ordered gradation value Sin can be obtained by the following equation if it is assumed that the correction value obtained by linear interpolation using the color strength correction value Hb for the ordered gradation value Sb and the color strength correction value Hc for the ordered gradation value Sc is represented as H'.

$$Sout=Sin\times(1+H') \quad (4)'$$

As described above, the color strength correction processing is performed for each raster line.

When a nozzle array is changed, the aforementioned correction value obtaining processing is performed on at least the chanced nozzle array. For example, when the nozzle array which discharges the W ink is changed from the nozzle array N6 to the nozzle array N9 as shown in FIG. 10, the aforementioned correction value obtaining processing is performed with the use of the nozzle array N9. Then, the obtaining correction value table is set as a new correction value table for the W ink. In addition, when printing is performed, the new correction value table is applied. In so doing, it is possible to suppress the occurrence of non-uniformity of the color strength due to the change of the nozzle array.

As described above, according to the embodiment, when the presence of a non-discharging nozzle in the nozzle array N6 is detected in the nozzle check, an ink cartridge for the W ink is moved to the cartridge holder H9 corresponding to the preliminary nozzle array N9. Then, discharge timing and the like are controlled such that the W ink to be discharged from the nozzle array N6 is discharged from the nozzle array N9. In so doing, it is possible to perform printing with the use of another nozzle array even when a non-discharging nozzle is detected in a certain nozzle array. Accordingly, it is possible to avoid head replacement due to the presence of the non-discharging nozzle.

Although the description was made of the embodiment in which an ink cartridge for each ink color is attached to a corresponding cartridge holder, the invention is not limited thereto, and a configuration is also applicable in which a container which respectively corresponds to each nozzle array of the head 31 is provided to directly contain ink therein. Then, when a non-discharging nozzle is detected, the ink in the container may be moved.

Modified Example of First Embodiment

According to the aforementioned embodiment, a cartridge is replaced, and a nozzle array to be used is changed (a original nozzle array is not used), when there is a non-discharging nozzle. On the other hand, according to this modified example, both the original nozzle array (hereinafter, also referred to as an old nozzle array) and the newly used nozzle array (hereinafter, referred to as a new nozzle array) are used for printing. For example, both the nozzle array N6 (old nozzle array) and the nozzle array N9 (new nozzle array) in FIG. 10 are allowed to discharge the W ink, and the nozzle array to be used is shifted for each print region R. In such a case, a non-discharging nozzle in the old nozzle array is not used, and a nozzle, which is at the same position as that of the non-discharging nozzle in the array direction (whose nozzle number is the same), in the new nozzle array is always used. In so doing, it is possible to suppress clogging of nozzles (nozzles other than the non-discharging nozzle) in the old nozzle array.

Alternatively, a nozzle in the new nozzle array (a nozzle at the same position as that of the non-discharging nozzle in the array direction) is used instead of the non-discharging nozzle, and nozzles other than the non-discharging nozzle in the old nozzle array may be used. Moreover, the old nozzle array may be used only when flushing is performed. In such a case as well, it is possible to suppress nozzle clogging in the old nozzle array in the same manner.

Second Embodiment

According to the first embodiment, a preliminary nozzle array is provided. On the other hand, according to the second embodiment, the preliminary nozzle array is not provided. That is, all nozzle arrays are used from the first stage. According to the second embodiment, the configuration of the printer 1 and operations other than the nozzle array change processing are the same as those in the first embodiment (FIG. 8). Accordingly, description will be given only of the nozzle change processing according to the second embodiment.

Figures 16, 17:
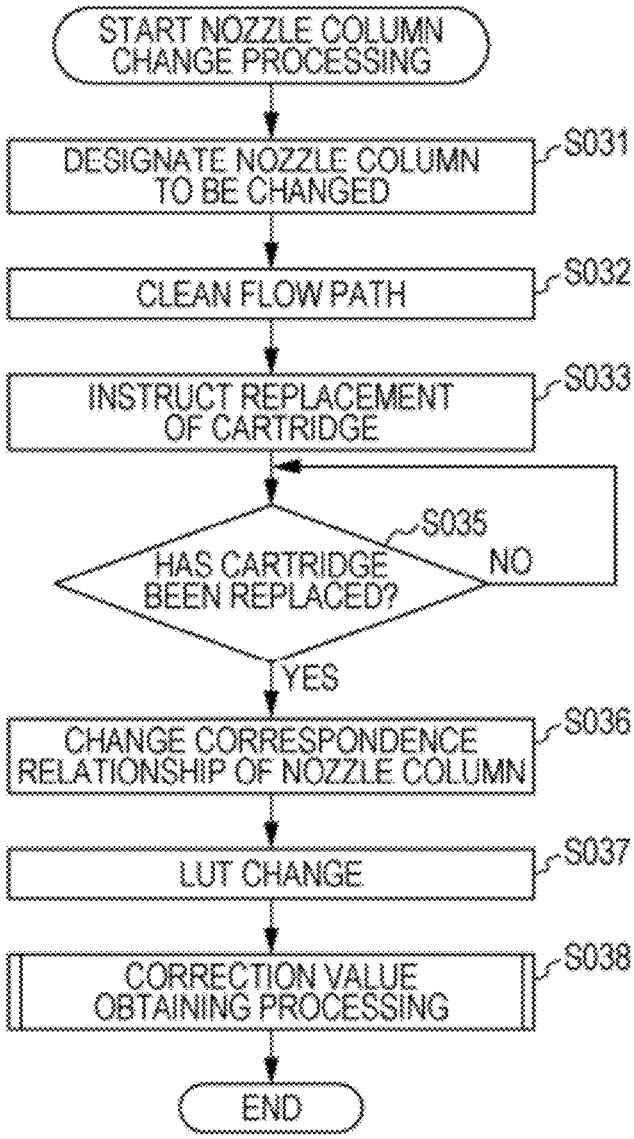
FIG. 16 is a diagram showing a flow of nozzle array change processing according to a second embodiment.
FIG. 17 is a diagram showing correspondence relationships between a nozzle array and ink (color) before and after nozzle array change processing according to the second embodiment.

FIG. 16 is a diagram showing a flow of nozzle change processing according to the second embodiment. In addition, FIG. 17 is a diagram showing correspondence relationships between a nozzle array and ink (color) before and after nozzle array change processing according to the second embodiment.

As shown in FIG. 17, yellow (Y), magenta (M), cyan (C), black (K), clear (Op), matte black (Mk), green (Gr), orange (Or), and white (W) are set as the ink (colors) corresponding to the nozzle arrays N1 to N9 before the nozzle array change processing. That is, ink cartridges for corresponding ink are attached to the cartridge holders H1 to H9. For example, the ink cartridge for W ink is attached to the cartridge holder H9.

Hereinafter, description will be given of processing when clogging is detected in a nozzle in the nozzle array N9 (W) in the nozzle inspection. First, the controller 60 causes a display in the host computer 110 to display a screen showing a result of the nozzle inspection and nozzle selection and allows a user to designate an alternative nozzle array (S031). In such a case, it is not possible to select the alternative nozzle array from the YMC nozzle arrays (nozzle arrays N1 to N3), and the user is allowed to select the alternative nozzle array from the nozzle arrays other than YMC (nozzle arrays N4 to N8). In this embodiment, it is assumed that matte black (Mk) which is less frequently used is selected. In such a case, the user removes the ink cartridge for matte black from the cartridge holder H6. Thereafter, cleaning of an ink flow path corresponding to the cartridge holder H6 (nozzle array N6) is performed (S032). Then, the controller 60 instructs the user to change the ink cartridge (S033). Specifically, the controller 60 causes the display of the host computer 110 to display a screen for instructing the replacement of the ink cartridge for the W ink from the cartridge holder H9 to the cartridge holder H6. The controller 60 determines whether or not the change of the ink cartridge has been completed by reading information of the storage element in the ink cartridge attached to the cartridge holder H6 (S034).

When it is determined that the change of the ink cartridge has been completed (Yes in S034), the controller 60 changes a correspondence relationship between each nozzle array and ink to be discharged (S035). According to the second embodiment, the correspondence relationship between ink and a nozzle array is changed such that the nozzle array N6 discharges the W ink as shown in FIG. 17. Since the Mk ink is not used in such a case, the controller 60 changes the aforementioned color conversion LUT on the assumption that Mk is not used (S036). When black is printed in this case, only K ink in the nozzle array N4 is used.

Thereafter, the controller 60 executes the correction value obtaining processing (S037). Since the correction value obtaining processing is performed in the same manner as in the first embodiment, the description thereof will be omitted.

As described above, according to the second embodiment, change is made such that the W ink to be discharged from the nozzle array N9 is discharged from the nozzle array N6 for matte black (Mk) which is less frequently used. In addition, black (K) is used instead of matte black (Mk). Since the preliminary nozzle array is not provided, it is possible to efficiently use the nozzle arrays N1 to N9.

Although the description was given of the embodiment in which the Mk ink which is less frequently used is selected as a target of the change for the W ink, another color may be selected from among colors other than YMC. For example, the Gr ink may be selected not to be used. In such a case, it is possible to print green color with the use of the C ink and Y ink. However, expression range of the green color is changed in the case in which the Gr ink is used and in the case in which the Gr ink is not used (in the case in which the C ink and the Y ink are mixed), and therefore, it is necessary to change the color conversion LUT used in Step S036 from the table in the case of using the Gr ink to the table in the case in which the Gr ink is not used. Similarly, the Or ink may be selected not to be used, and the orange color may be printed with the use of the M ink and the Y ink. Moreover, the K ink may be selected not to be used, and the black color may be printed with the use of the C ink, the M ink, and the Y ink.

In the second embodiment as well, a configuration is also applicable in which the old nozzle array is also capable of discharging ink and both the new nozzle array and the old nozzle array are used together, in the same manner as in the modified example of the first embodiment.

Third Embodiment

According to the aforementioned embodiment, the number of head provided in the carriage 42 is one. On the other hand, according to the third embodiment, a plurality of (three in this embodiment) heads are provided in the carriage 42.

Figure 18:
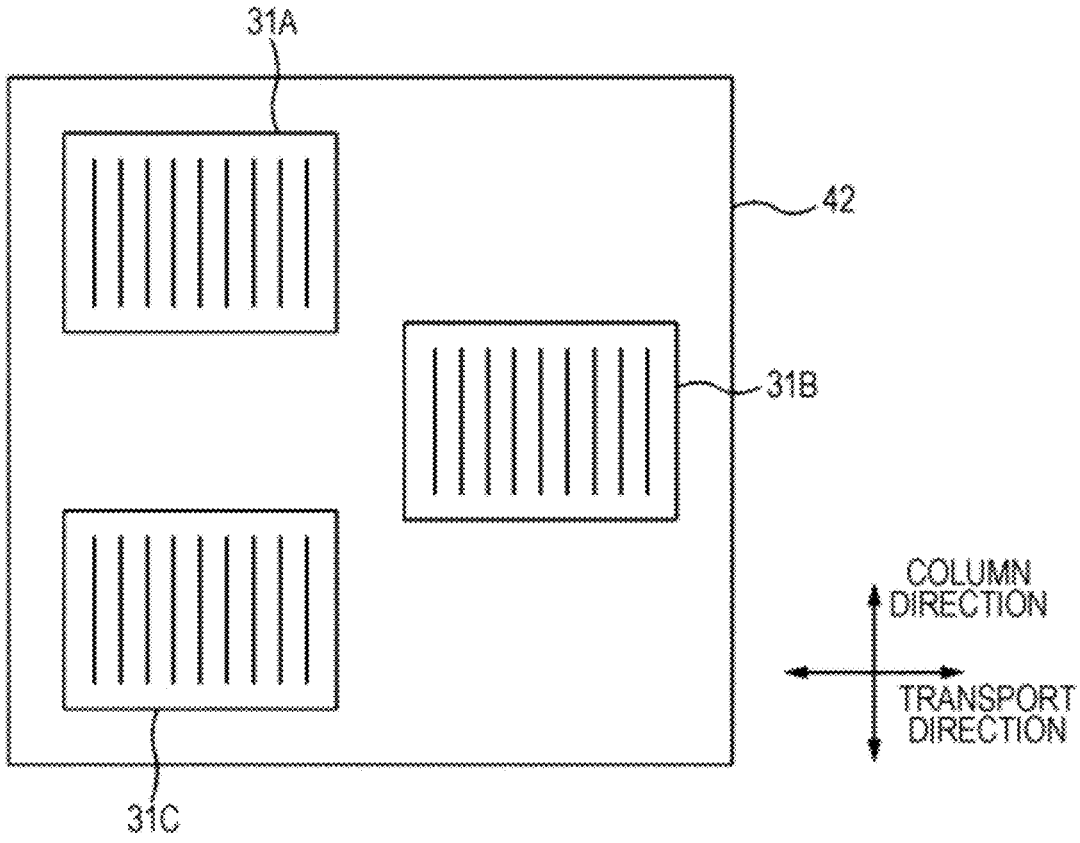
FIG. 18 is a diagram showing a head arrangement according to a third embodiment.

FIG. 18 is a diagram showing an example of head arrangement according to the third embodiment. Three heads (a head 31A, a head 31B, and a head 31C) are provided in the carriage 42. A configuration of each head is the same as that of the head 31 in the aforementioned embodiments. In addition, cartridge holders H1 to H9 are provided for each head, and ink is supplied from an ink cartridge for each color for each head. According to the third embodiment, all nine nozzle arrays are used in the same manner as in the second embodiment.

Figure 19B:
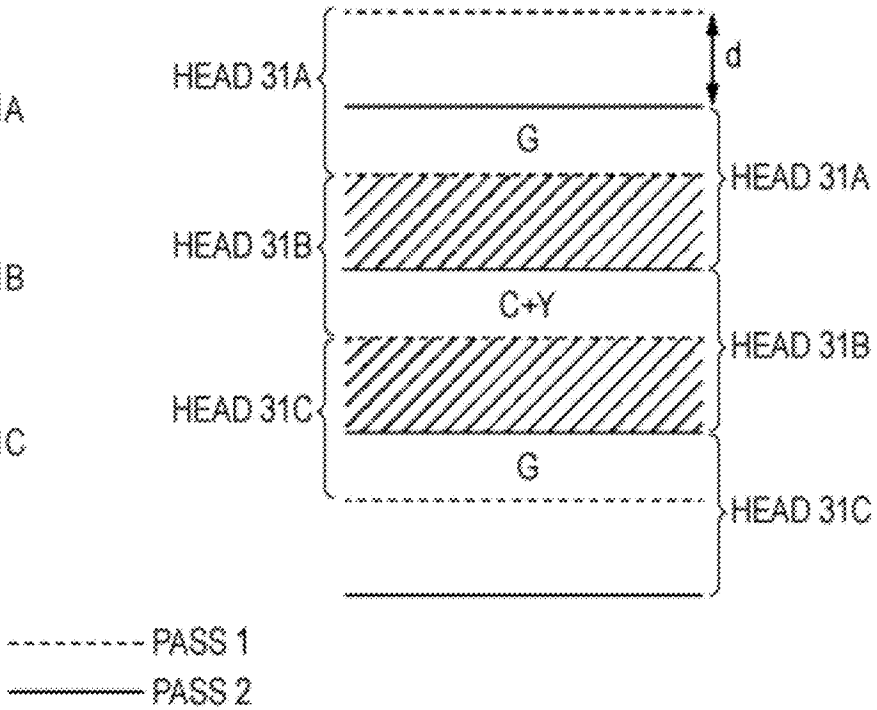
FIGS. 19A and 19B are explanatory diagrams of images formed in the third embodiment.
Figure 19A:
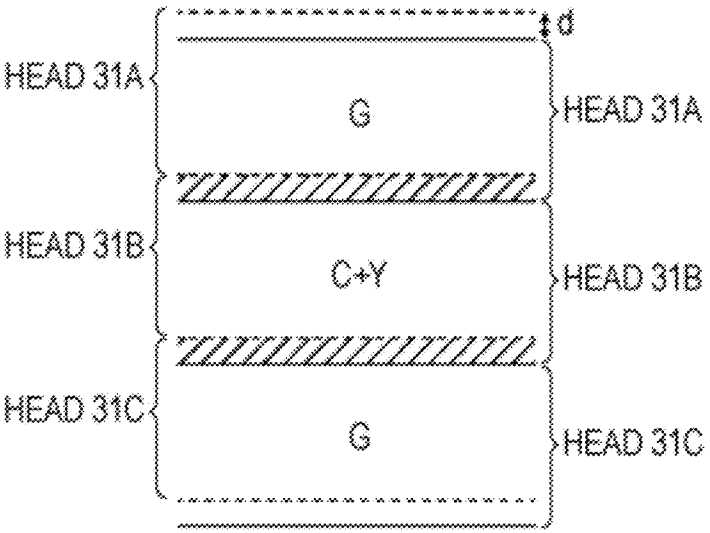

FIGS. 19A and 19B are explanatory diagrams of an image formed in the third embodiment. FIG. 19A is an explanatory diagram when the distance d (a value for changing lines) is short, and FIG. 19B is an explanatory diagram when the distance d is long. Here, it is assumed that printing is performed with two passes for simplifying the explanation. In the drawings, a dotted line represents an end position of a region (raster line) in the array direction, which is to be printed by each head by pass 1, and a solid line represents an end position of a region (raster line) in the array direction, which is to be printed by each head by pass 2. The carriage 42 (namely, each head) is moved in the array direction by the distance d between the pass 1 and the pass 2. In the drawings, a hatched part represents a region to be printed with different heads during the two passes.

According to the third embodiment, it is assumed that a nozzle in a nozzle array for the white ink in one head (the head 31B, for example) clogs from among the three heads in FIG. 18 and that the green nozzle array is selected instead thereof. The nozzle array change processing in this case is the same as that in the second embodiment. In so doing, the Gr ink cannot be discharged from the head 31B, the green color is printed by the head 31B with the use of the Y ink and the C ink. On the other hand, the green color is printed with the Gr ink by the heads 31A and the head 31C.

Since the distance d is short in FIG. 19A, a region formed only with one head is large, and a region formed with a plurality of heads (a region corresponding to the hatched part) is small. Therefore, a color difference between a region in which the green color is printed with the use of the Gr ink (a region shown as (Gr) in the drawing) and a region in which the green color is printed with the use of the C ink and the Y ink (a region shown as (C+Y) in the drawing) is noticeable.

On the other hand, the distance d is long in FIG. 19B. As compared with FIG. 19A, the region formed with a plurality of heads is large, and the region formed with only one head is small. Specifically, an overlapped region (hatched part) between a part in which the green color is printed with the use of the Gr ink and a part in which the green color is printed with the use of the Y ink and the C ink is larger than that in FIG. 19A. In addition, a region in which the green color is printed with the Gr ink both in the pass 1 and in the pass 2 (a region shown as (G) in the drawing) and a region in which the green color is printed with the use of the C ink and the Y ink both in the pass 1 and in the pass 2 (a region shown as (C+Y) in the drawing) are smaller than those in FIG. 19A. Therefore, a difference in a green color printed by each head is less noticeable than the case in FIG. 19A.

By setting the distance d (the value for changing lines) to be long as described above, it is possible to allow the color difference to be imperceptible even when a nozzle array in one head is replaced from among the three heads. Although the description was given of the embodiment in which an image is formed with two passes for convenience of explanation, the total value for changing lines (a movement distance 7*d* in the array direction by eight passes in this case) may be set to be longer than the length of each head 31 in the array direction when the print region R (one page) is printed with eight passes as described above, for example. In so doing, it is possible to naturally express a boundary between regions for each which different ink is used by each head.

Although the description was given of the embodiment in which the number of heads was three, the invention is not limited thereto, and the number of heads may be any number as long as it is more than one. For example, two head may be provided, or four or more heads may be provided. In such cases, the same effect can be achieved. Although the heads are arranged in a zigzag manner in the embodiment, the invention is not limited thereto. For example, a plurality of heads may be arranged in a linear shape. Although the Gr ink is not used in one head (the head 31B) from among the three heads, another color may be selected not to be used. For example, the Or ink may be selected not to be used, and the orange color may be printed with the use of the M ink and the Y ink. Moreover, the K ink may be selected not to be used, and the black color may be printed with the use of the C ink, the M ink, and the Y ink. It is possible to allow the color difference between heads to be imperceptible in the same manner in this case as well.

Other Embodiments

Although above embodiments are described mainly in relation to a liquid discharge apparatus, the embodiments also disclose a liquid discharge method and the like. In addition, the above embodiments are described solely for ease of understanding of the invention, and limited interpretation of the invention is not intended. It is needless to say that any modifications and enhancements can be made within the scope of the invention and that the equivalents thereof are also included in the invention. In particular, the following embodiments are also included in the invention.

Liquid Discharge Apparatus

The above description was given of the embodiments in which an ink jet printer was exemplified as a liquid discharge apparatus. However, the liquid discharge apparatus is not limited to an ink jet printer, and it is also possible to realize the invention in a liquid discharge apparatus which discharge fluid other than ink (liquid, a substance in a liquid state in which functional material particles are dispersed, a substance in a fluid state such as gel). For example, it is also possible to apply the same technique as that in the aforementioned embodiments to various apparatuses, to which an ink jet technique is applied, such as a color filter manufacturing apparatus, a dyeing apparatus, a microfabrication apparatus, a semiconductor manufacturing apparatus, a surface processing apparatus, a three-dimensional modeling apparatus, a gasification apparatus, an organic EL manufacturing apparatus (a polymer EL manufacturing apparatus, in particular), a display manufacturing apparatus, a film formation apparatus, a DNA chip manufacturing apparatus, and the like. Such methods and manufacturing methods are also within the range of application.

Although the above description was given of the embodiments of a lateral type printer, the invention is not limited thereto, and a serial type printer which alternately performs a pass and a medium transport operation may also be used.

Concerning Ink

Although ink is discharged from nozzles since a printer is exemplified in the aforementioned embodiment, the ink may be water-based ink or oil-based ink. In addition, the liquid discharged from the nozzles is not limited to ink. For example, liquid (including water) containing a metal material, an organic material (a polymer material, in particular), a magnetic material, a conductive material, a wire material, a film formation material, electronic ink, liquid for processing, gene solution, and the like.

Concerning Discharge Scheme

According to the aforementioned embodiments, ink is discharged with the use of a piezoelectric element. However, a scheme for discharging liquid is not limited thereto. For example, another scheme such as a scheme of generating foam in the nozzles by heating may also be used.

Concerning Containing of Ink

Although an ink cartridge for ink of each color is attached to a cartridge holder in the aforementioned embodiments, the invention is not limited thereto. For example, a configuration is also applicable in which an ink container for supplying ink is provided for each nozzle array and ink is directly contained in the container.

The entire disclosure of Japanese Patent Application No. 2011-53262, filed Mar. 10, 2011 is expressly incorporated by reference herein.

What is claimed is:

1. A liquid discharge method comprising:

performing in a liquid ejecting apparatus a discharge operation of discharging liquid from each nozzle in a plurality of nozzle arrays, to each of which liquid is supplied from a corresponding container, the plurality of nozzle arrays corresponding to the plurality of containers which respectively contain a plurality of kinds of liquid, the nozzles being arranged in an array direction;

detecting whether or not the liquid is discharged from each nozzle by the discharge operation;

when it is detected that there is a nozzle which does not discharge liquid in a certain nozzle array, moving a container holding liquid that was being discharged by the certain nozzle array to another location in the liquid ejecting apparatus so that a nozzle array that is different from the certain nozzle array can discharge liquid in the container; and controlling the nozzle array which is different from the certain nozzle array to discharge the liquid to be discharged from the certain nozzle array.

2. The liquid discharge method according to claim 1, wherein the nozzle array which is different from the certain nozzle array is a preliminary nozzle array.

3. The liquid discharge method according to claim 1, wherein a container corresponding to the certain nozzle array contains first liquid, and a container corresponding to the nozzle array which is different from the certain nozzle array contains second liquid, and wherein when it is detected that there is a nozzle which does not discharge liquid in the certain nozzle array, the liquid to be contained in the container corresponding to the nozzle array which is different from the certain nozzle array is changed from the second liquid to the first liquid.

4. The liquid discharge method according to claim 3, wherein in a case in which liquid contained in a container corresponding to the nozzle array which is different from the certain nozzle array is changed from the second liquid to the first liquid, and color of the second liquid is created by combining liquid other than the second liquid in a predetermined head, in the predetermined head among a plurality of heads, each of which is provided with the plurality of nozzle arrays, arranged in an array direction, and provided with containers corresponding to the nozzle arrays, when a pass during which liquid is discharged from each nozzle array of each head while the plurality of heads are moved in a direction perpendicular to the array direction and a line change for displacing relative positions of the plurality of heads and the medium in the array direction between passes are alternately performed to form an image in a print region by a predetermined value, an addition value of the predetermined value due to the line change executed for the print region is set to be greater than length of each nozzle array in the array direction.

5. The liquid discharge method according to claim 1, wherein after detecting that there is a nozzle which does not discharge liquid in the certain nozzle array, nozzles other than the nozzle which does not discharge liquid are continuously used from among the nozzles in the certain nozzle arrays.

6. The liquid discharge method according to claim 5, wherein the certain nozzle array and the nozzle array which is different from the certain nozzle array are alternately used every time the discharge operation is performed on a predetermined region in a medium.

7. The liquid discharge method according to claim 5, wherein the certain nozzle array is used during flushing.

8. The liquid discharge method according to claim 1, further comprising:

forming in the array direction a plurality of dot arrays in which dots are arranged in the perpendicular direction on the medium by discharging liquid to be discharged from the certain nozzle array by each nozzle in the nozzle array which is different from the certain nozzle array while the nozzle array which is different from the certain nozzle array is moved in the direction perpendicular to the array direction;

detecting color strength of each dot array;

calculating color strength correction value for each dot array based on the detected color strength; and applying the correction value when the liquid to be discharged from the certain nozzle array is discharged from each nozzle in the nozzle array which is different from the certain nozzle array.

* * * * *